US011635089B2

(12) United States Patent
Teramoto et al.

(10) Patent No.: US 11,635,089 B2
(45) Date of Patent: Apr. 25, 2023

(54) PROPELLER FAN, OUTDOOR UNIT, AND REFRIGERATION CYCLE APPARATUS

(71) Applicant: Mitsubishi Electric Corporation, Tokyo (JP)

(72) Inventors: Takuya Teramoto, Tokyo (JP); Takashi Ikeda, Tokyo (JP); Yusuke Adachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 836 days.

(21) Appl. No.: 16/323,904

(22) PCT Filed: Oct. 27, 2016

(86) PCT No.: PCT/JP2016/081818
§ 371 (c)(1),
(2) Date: Feb. 7, 2019

(87) PCT Pub. No.: WO2018/078757
PCT Pub. Date: May 3, 2018

(65) Prior Publication Data

US 2020/0018321 A1 Jan. 16, 2020

(51) Int. Cl.
*F04D 29/38* (2006.01)
*F24F 1/38* (2011.01)

(52) U.S. Cl.
CPC ..... *F04D 29/384* (2013.01); *F24F 1/38* (2013.01); *F05D 2240/30* (2013.01)

(58) Field of Classification Search
CPC ..... F04D 29/181; F04D 29/32; F04D 29/325; F04D 29/329; F04D 29/384; F24F 1/38; F05D 2240/30
(Continued)

(56) References Cited

U.S. PATENT DOCUMENTS 4,840,541 A * 6/1989 Sakane ..... F04D 29/384 416/223 R
5,066,196 A * 11/1991 Morofushi ..... F04D 29/325 416/241 A
(Continued)

FOREIGN PATENT DOCUMENTS

JP H05-340383 A 12/1993
JP 2000-002193 A 1/2000
(Continued)

OTHER PUBLICATIONS

International Search Report of the International Searching Authority dated Jan. 31, 2017 for the corresponding international application No. PCT/JP2016/081818 (and English translation).
(Continued)

*Primary Examiner* — Woody A Lee, Jr.
*Assistant Examiner* — Justin A Pruitt
(74) *Attorney, Agent, or Firm* — Posz Law Group, PLC

(57) ABSTRACT

A propeller fan includes: a rotation-axis part that serves as a center of rotation; and a plurality of blades provided on an outer circumferential side of the rotation-axis part, the plurality of blades being joined to adjoining blades at leading edges and trailing edges thereof. A first rib projecting towards the center of rotation of the rotation-axis part to surround the rotation-axis part, and second ribs projecting towards the center of rotation to extend from the rotation-axis part toward the first rib are provided on pressure surfaces of the plurality of blades. Among ends of the second ribs in the direction of the center of rotation, the ends distant from the pressure surfaces project away from the pressure surfaces farther than an end of the first rib distant from the pressure surfaces, among the ends of the first rib in the direction of the center of rotation.

12 Claims, 14 Drawing Sheets

(58) Field of Classification Search
USPC ..... 62/428
See application file for complete search history.

(56) References Cited

U.S. PATENT DOCUMENTS 5,236,306 A * 8/1993 Hozak ..... B60H 1/00464 416/93 R
5,967,748 A * 10/1999 Jang ..... F04D 29/522 62/428
6,375,427 B1 * 4/2002 Williams ..... F04D 29/646 416/169 A
6,384,494 B1 * 5/2002 Avidano ..... F04D 25/0613 310/58
6,565,320 B1 * 5/2003 Suris ..... F04D 29/384 416/175
7,042,121 B2 * 5/2006 De Filippis ..... F04D 29/329 310/58
8,556,587 B2 * 10/2013 Suzuki ..... B29C 33/44 416/193 R
10,393,136 B2 * 8/2019 Aschermann ..... F04D 29/666
2013/0287581 A1 10/2013 Aschermann et al.
2018/0003190 A1 1/2018 Hamada et al.

FOREIGN PATENT DOCUMENTS

JP 2003-531341 A 10/2003
WO 2016/021555 A1 2/2016

OTHER PUBLICATIONS

Indian Examination Report dated Mar. 3, 2021, issued in corresponding Indian Patent Application No. 201947013854 (and English Machine Translation).

* cited by examiner

PROPELLER FAN, OUTDOOR UNIT, AND REFRIGERATION CYCLE APPARATUS

CROSS REFERENCE TO RELATED APPLICATION

This application is a U.S. national stage application of PCT/JP2016/081818 filed on Oct. 27, 2016, the contents of which are incorporated herein by reference.

TECHNICAL FIELD

The present invention relates to a so-called integrated-wing propeller fan, in which blades are each joined at leading edge thereof to a trailing edge of an adjoining blade of the blades, and an outdoor unit and a refrigeration cycle apparatus having the propeller fan.

BACKGROUND ART

Refrigeration cycle apparatuses perform operations, such as heating and cooling of a target space or other place, by circulating refrigerant through a refrigerant circuit. These refrigeration cycle apparatuses often include an indoor unit (indoor device) and an outdoor unit (outdoor device). The outdoor unit is provided with a propeller fan, serving as an air-sending device, having blades (propeller). By rotating the propeller fan to generate an airflow, an air-sending operation, such as cooling or heat release, is performed.

Typically, the above-described propeller fan is configured such that a plurality of blades are joined to the outer circumferential side of a cylindrical boss part, which is connected to a rotary shaft of a driving source, such as a motor. In the propeller fan having the boss part, a weight reduction is difficult because of the heavy boss part. Thus, it is difficult to promote resource saving (reduce the environmental load). In addition, there has been a problem in that it is difficult improve the air-sending efficiency of the fan because the boss part does not have an air-sending function.

To overcome such a problem, a so-called integrated-wing propeller fan having: a rotation-axis part (center of rotation) connected to a rotary shaft of a driving source, such as a motor; and a plurality of blades provided on the outer circumferential side of the rotation-axis part has been proposed, in which the adjoining blades are joined to one another at the leading edges and trailing edges thereof. This integrated-wing propeller fan is configured such that the adjoining blades are joined to one another via a continuous surface, not a boss part. Hence, in the integrated-wing propeller fan, the minimum radius of the continuous surface extending between the blades, centered at the rotation-axis part (center of rotation), is greater than the radius of the rotation-axis part. Hence, the integrated-wing propeller fan can overcome the above-described problem in the propeller fan having the boss part.

However, in the integrated-wing propeller fan, the amount of deformation of the blades during rotation is large due to insufficient strength of the blades, leading to a problem, such as a decrease in the air-sending performance. To overcome this problem, an integrated-wing propeller fan having, around the rotation-axis part, ribs for compensating for the insufficient strength of the blades has been proposed. For example, an integrated-wing propeller fan disclosed in Patent Literature 1 is configured such that the rotation-axis part projects toward a pressure-surface side of the blades. Ribs extending radially from the rotation-axis part are formed on the pressure surfaces of the blades. According to Patent Literature 1, the radially extending ribs also function as a turbo fan, thus improving the air-sending performance of the integrated-wing propeller fan.

CITATION LIST

Patent Literature

Patent Literature 1: International Publication No. 2016/021555

SUMMARY OF INVENTION

Technical Problem

The main flow of an airflow generated by an integrated-wing propeller fan when it rotates flows on the outer circumferential side of the blades. Hence, the air does not flow actively on the downstream side of the rotation-axis part and stagnates, thus generating a large separation area on the downstream side of the rotation-axis part. In the propeller fan disclosed in Patent Literature 1, it is possible to diffuse the air near the outer circumferential ends during rotation, at positions near the outer circumferential ends of the radially extending ribs formed on the pressure surfaces. Hence, in the propeller fan disclosed in Patent Literature 1, as a result of being attracted of the diffused air to the main flow, it is possible to allow the main flow to move slightly toward the inner circumferential side (rotation-axis part side). However, even the propeller fan disclosed in Patent Literature 1 has a problem in that it is impossible to generate a sufficient airflow on the downstream side of the rotation-axis part to reduce the separation area generated on the downstream side of the rotation-axis part.

The present invention has been made in view of the above-described problems, and a first object thereof is to provide an integrated-wing propeller fan in which it is possible to reduce the separation area generated on the downstream side of the rotation-axis part, compared with that in the related-art propeller fan. A second object is to provide an outdoor unit and refrigeration cycle apparatus having this propeller fan.

Solution to Problem

A propeller fan according to an embodiment of the present invention includes: a rotation-axis part that serves as a center of rotation of the propeller fan; and a plurality of blades provided on an outer circumferential side of the rotation-axis part, the plurality of blades each being joined at an leading edge of the blade to a trailing edge of an adjoining blade of the blades, the propeller fan having a first rib provided on pressure surfaces of the plurality of blades, the first rib projecting in a direction of the center of rotation of the rotation-axis part and surround the rotation-axis part, and second ribs provided on pressure surfaces of the plurality of blades, the second ribs projecting in the axial direction of the rotation-axis part and extending from the rotation-axis part toward the first rib, and wherein, of ends of the second ribs in the axial direction of the rotation-axis part, ends, distant from the pressure surfaces, of the second ribs project in a direction away from the pressure surfaces farther than an end of the first rib distant from the pressure surfaces, among the ends of the first rib in the axial direction of the rotation-axis part.

Advantageous Effects of Invention

In the propeller fan according to an embodiment of the present invention, it is possible to diffuse, by means of the first ribs, the airflow generated by the rotation of the blades toward the inner circumferential side. In addition, in the propeller fan according to an embodiment of the present invention, it is possible to further diffuse, by means of the second ribs, the flow diffused by the first ribs toward the downstream side of the rotation-axis part. Hence, in the propeller fan according to an embodiment of the present invention, it is possible to generate a sufficient airflow on the downstream side of the rotation-axis part to reduce the separation area generated on the downstream side of the rotation-axis part, compared with that in the related-art propeller fan.

DESCRIPTION OF EMBODIMENTS

Embodiments of the present invention will be described below with reference to the drawings.

Embodiment 1

First, the configuration of an outdoor unit according to Embodiment 1 of the present invention will be described. In Embodiment 1, an outdoor unit of an air-conditioning apparatus, which is an example of the outdoor unit, will be described. Note that the outdoor unit according to Embodiment 1 may be, for example, an outdoor unit of a water heater, which may have the same configuration as the outdoor unit of the air-conditioning apparatus.

Figure 1:
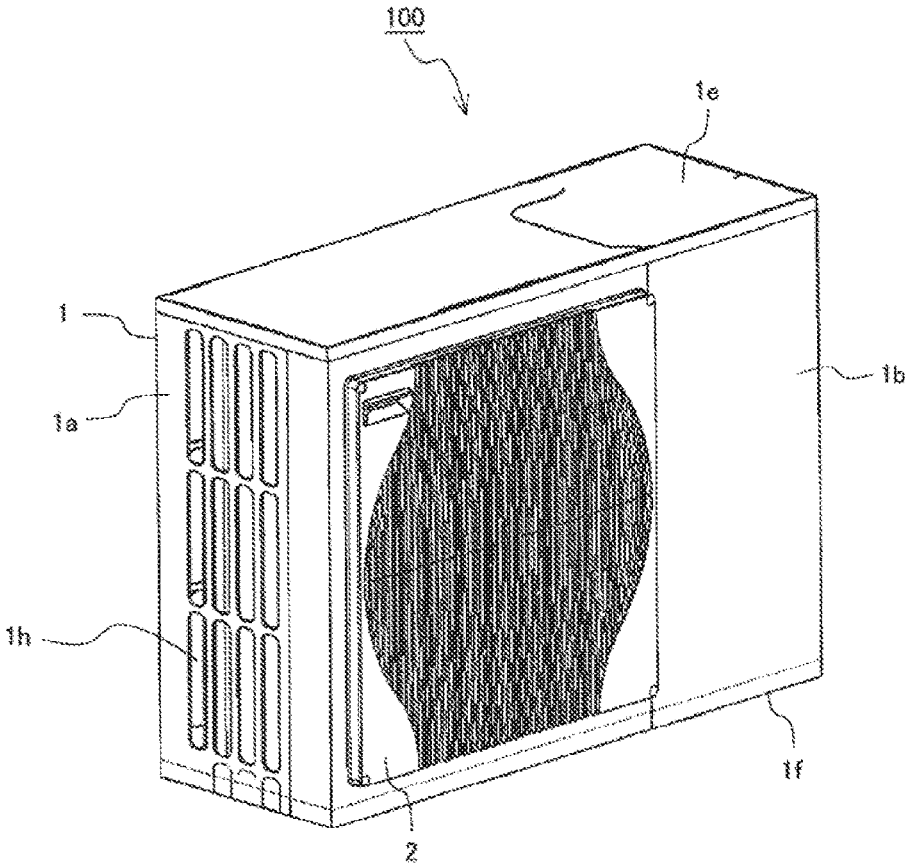
FIG. 1 is a perspective view of an outdoor unit according to Embodiment 1 of the present invention, as viewed from the front side.
Figure 2:
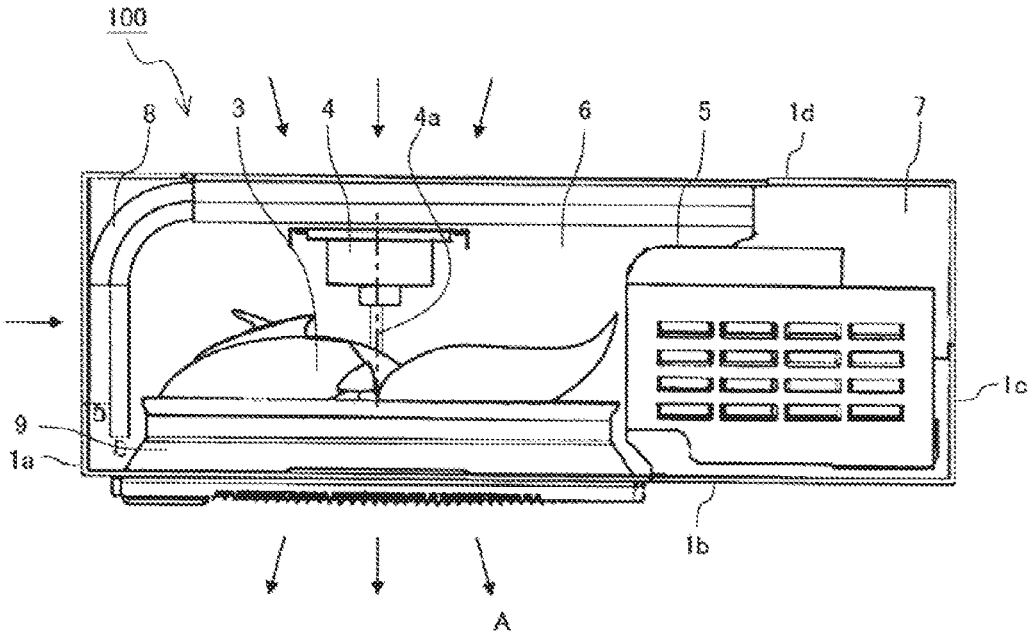
FIG. 2 is a plan view of the outdoor unit according to Embodiment 1 of the present invention, without a top-surface part of an outdoor unit body.
Figure 3:
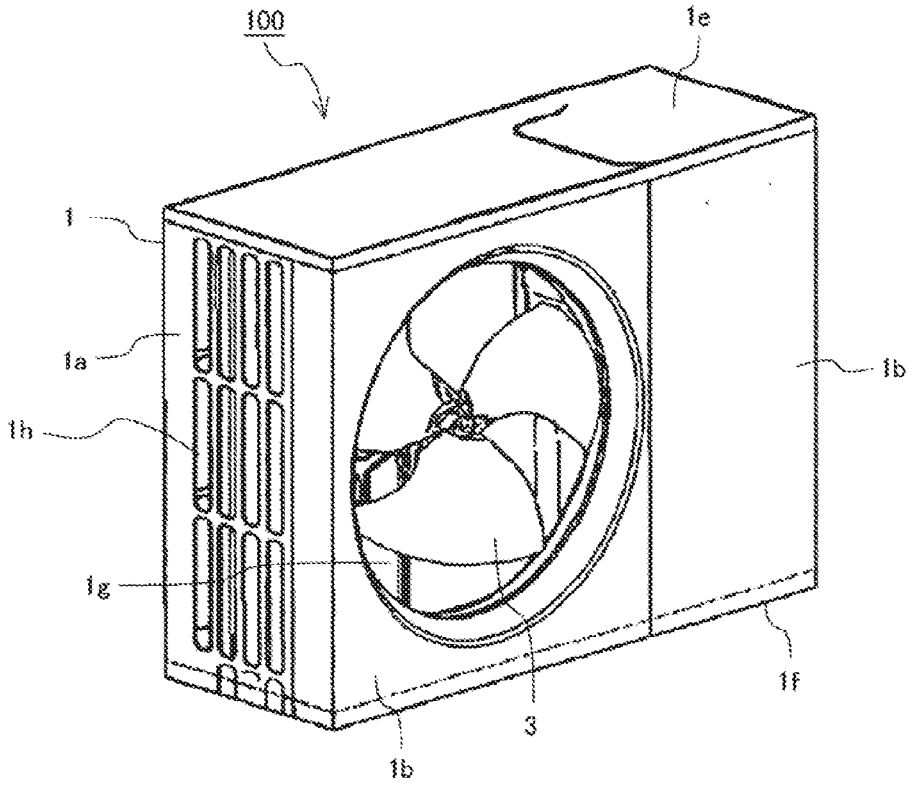
FIG. 3 is a perspective view of the outdoor unit according to Embodiment 1 of the present invention, without a fan grille, as viewed from the front side.
Figure 4:
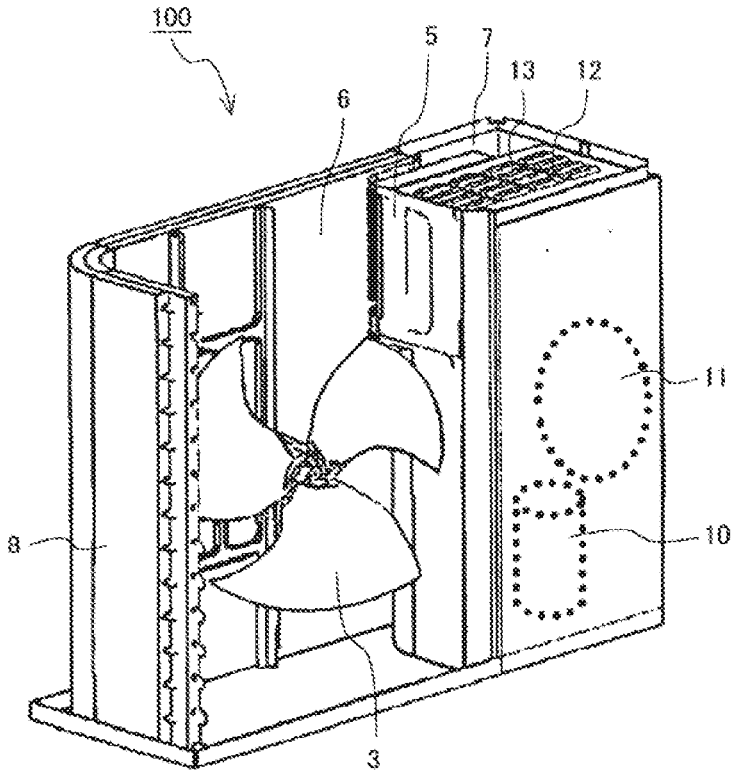
FIG. 4 is a perspective view of the outdoor unit according to Embodiment 1 of the present invention, without a first side-surface part, a portion of a front-surface part, and the top-surface part of the outdoor unit body.

FIG. 1 is a perspective view of the outdoor unit according to Embodiment 1 of the present invention, as viewed from the front side. FIG. 2 is a plan view of the outdoor unit according to Embodiment 1 of the present invention, without a top-surface part of an outdoor unit body. FIG. 3 is a perspective view of the outdoor unit according to Embodiment 1 of the present invention, without a fan grille, as viewed from the front side. FIG. 4 is a perspective view of the outdoor unit according to Embodiment 1 of the present invention, without a first side-surface part, a portion of a front-surface part, and the top-surface part of the outdoor unit body.

An outdoor unit 100 mainly includes: an outdoor unit body 1; a fan grille 2; a propeller fan 3, serving as an air-sending device; a fan motor 4; a partition plate 5; a fan chamber 6; a machine chamber 7; a heat exchanger 8; and a bell mouth 9.

The outdoor unit body 1 has, for example, a substantially rectangular-parallelepiped shape and constitutes the outer shell of the outdoor unit 100. The outdoor unit body 1 includes a first side-surface part 1*a*, a front-surface part 1*b*, a second side-surface part 1*c*, a back-surface part 1*d*, a top-surface part 1*e*, and a bottom-surface part 1*f*. The interior of the outdoor unit body 1 is sectioned into the fan chamber 6 and the machine chamber 7 by the partition plate 5. Openings, serving as air inlets 1*h*, through which air is taken into the outdoor unit body 1, are provided in the first side-surface part 1*a* and the back-surface part 1*d*, at portions constituting the fan chamber 6. Furthermore, an opening, serving as an air outlet 1*g*, through which the air is blown outside, is provided in the front-surface part 1*b*, at a portion constituting the fan chamber 6.

The propeller fan 3, the fan motor 4, the heat exchanger 8, and the bell mouth 9 are provided in the fan chamber 6. The heat exchanger 8 is provided in the fan chamber 6 to face the air inlets 1*h* provided in the first side-surface part 1*a* and the back-surface part 1*d*. Specifically, the heat exchanger 8 is formed in a substantially L shape in plan view. The heat exchanger 8 is configured as a fin-and-tube-type heat exchanger, which has a plurality of fins and heat transfer tubes, and exchanges heat with the air introduced by the propeller fan 3. The plurality of fins are arranged in parallel in the lateral direction with a predetermined distance therebetween, along the first side-surface part 1*a* and the back-surface part 1*d*. The plurality of heat transfer tubes are provided to penetrate through the plurality of fins. Specifically, the heat transfer tubes are formed in a substantially L shape in plan view. The heat transfer tubes are arranged in parallel in the top-bottom direction with a predetermined distance therebetween. Refrigerant circulating through a refrigerant circuit flows through the heat transfer tubes.

The propeller fan 3 is provided to face the air outlet 1*g* provided at the front-surface part 1*b*. Specifically, the above-described heat exchanger 8 is provided on the air-inlet side of the propeller fan 3. As will be described below, the propeller fan 3 has a rotation-axis part 30, serving as the center of rotation (see FIG. 5, for example). A rotary shaft 4*a* of the fan motor 4 is connected to the rotation-axis part 30. When the rotary shaft 4*a* of the fan motor 4 rotates, the propeller fan 3 also rotates about the rotation-axis part 30, serving as the center of rotation. The fan motor 4, which transmits a rotational driving force to the propeller fan 3 in this way, is disposed between the heat exchanger 8 and the propeller fan 3 in the front-rear direction of the outdoor unit body 1.

The details of the propeller fan 3 will be described below.

The bell mouth 9 is provided to project from the periphery of the air outlet 1*g* provided at the front-surface part 1*b* toward the propeller fan 3. The bell mouth 9 is disposed to cover the outer circumferential portion of the propeller fan 3 with a predetermined distance therebetween. With this configuration, the bell mouth 9 divides the air passage near the air outlet 1*g* into the air-inlet side and the air-outlet side. Furthermore, the air outlet 1*g* provided at the front-surface part 1*b* is covered by the fan grille 2. The fan grille 2 prevents contact between an object or foreign matter and the propeller fan 3 for the safety. The bell mouth 9 may be formed either as an integral part of the front-surface part 1*b* or as a separate member.

Furthermore, a compressor 10, pipes 11, and a board box 12 are provided in the machine chamber 7. The compressor 10 constitutes a portion of the refrigerant circuit and compresses the refrigerant circulating through the refrigerant circuit. The pipes 11 include pipes that connect the compressor 10 and the heat exchanger 8. The board box 12 accommodates a control substrate 13. The control substrate 13 controls the devices, such as the compressor 10, installed in the outdoor unit 100.

Next, the configuration of the propeller fan 3 according to Embodiment 1 will be described in more detail.

Figure 5:
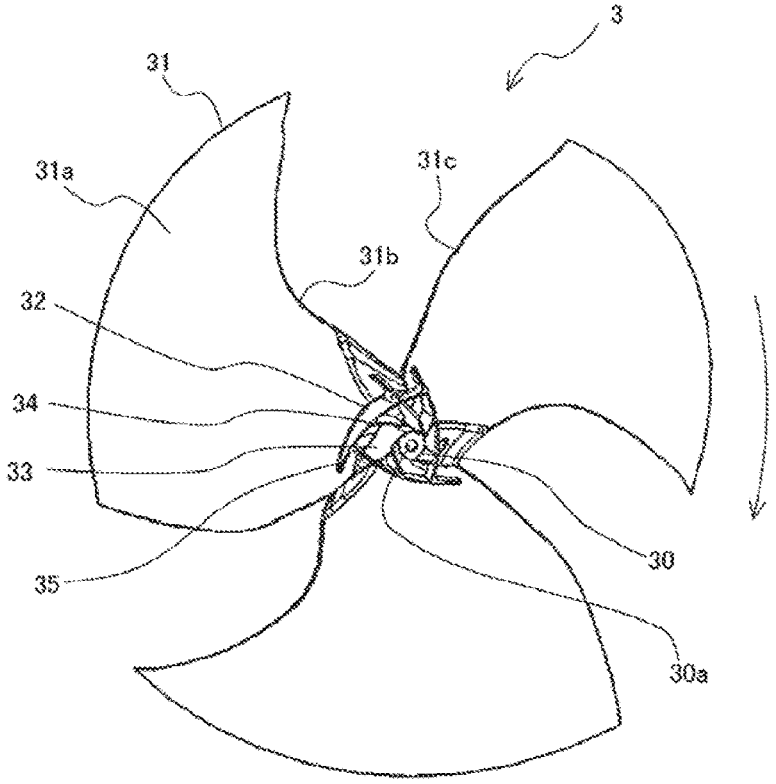
FIG. 5 is a perspective view of a propeller fan according to Embodiment 1 of the present invention, as viewed from the front side (the downstream side in the airflow direction).
Figure 6:
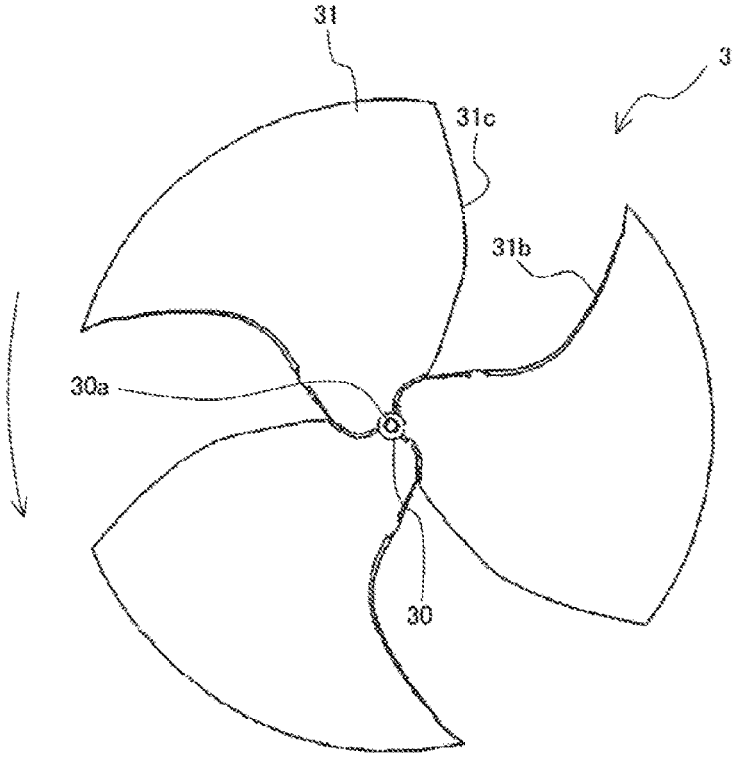
FIG. 6 is a back view of the propeller fan according to Embodiment 1 of the present invention.
Figure 7:
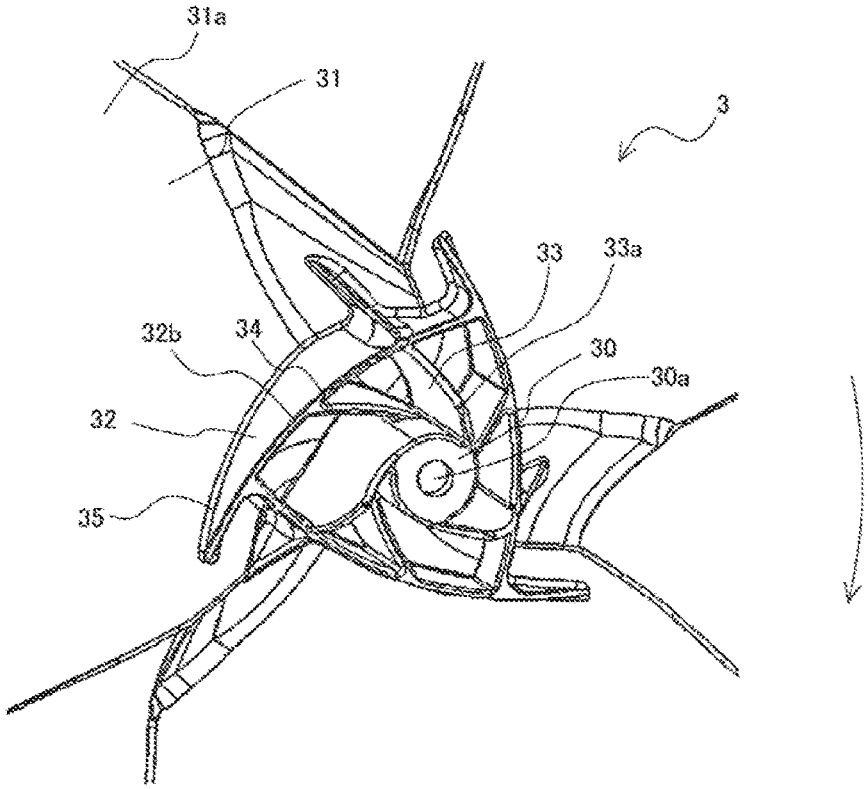
FIG. 7 is a perspective view of a rotation-axis part and the vicinity thereof of the propeller fan according to Embodiment 1 of the present invention, as viewed from the front side.
Figure 8:
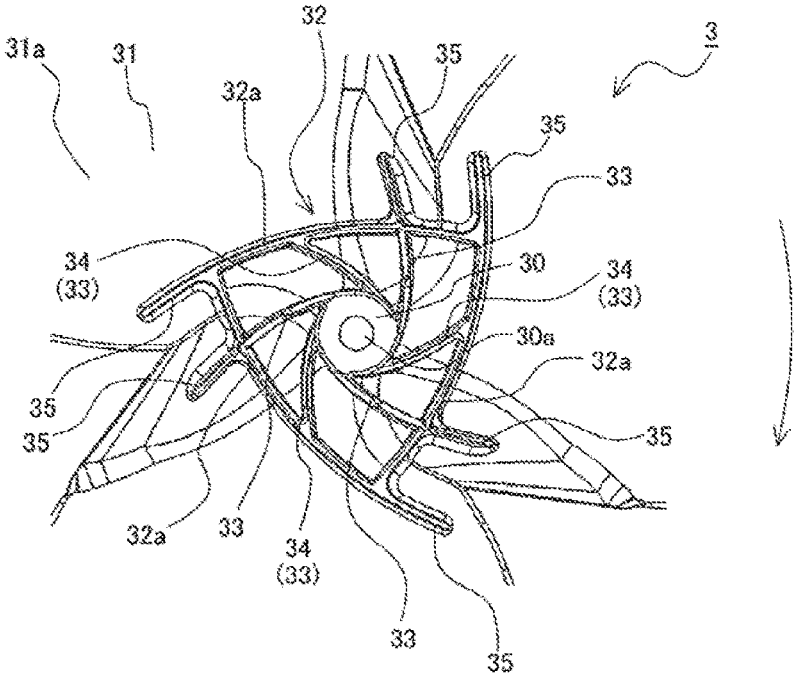
FIG. 8 is a front view of the rotation-axis part and the vicinity thereof of the propeller fan according to Embodiment 1 of the present invention.

FIG. 5 is a perspective view of the propeller fan according to Embodiment 1 of the present invention, as viewed from the front side. Specifically, FIG. 5 is a perspective view of the propeller fan 3, as viewed from the downstream side of the airflow generated by the propeller fan 3 (hereinbelow also simply referred to as the airflow). In other words, FIG. 5 is a perspective view of the propeller fan 3, as viewed from the side on which pressure surfaces 31*a* of blades 31 are located. In other words, FIG. 5 is a perspective view of the propeller fan 3, as viewed from the side on which the air outlet 1*g* in the outdoor unit body 1 is located. Furthermore, FIG. 6 is a back view of the propeller fan according to Embodiment 1 of the present invention. Specifically, FIG. 6 shows the propeller fan 3, as viewed from the upstream side of the airflow. Furthermore, FIG. 7 is a perspective view of the rotation-axis part and the vicinity thereof of the propeller fan according to Embodiment 1 of the present invention, as viewed from the front side. Furthermore, FIG. 8 is a front view of the rotation-axis part and the vicinity thereof of the propeller fan according to Embodiment 1 of the present invention. Note that arc-shaped arrows in FIGS. 5 to 8 indicate the rotation direction of the propeller fan 3.

The propeller fan 3 includes the rotation-axis part 30, serving as the center of rotation of the propeller fan 3, and a plurality of blades 31 (a propeller) provided on the outer circumferential side of the rotation-axis part 30. The rotation-axis part 30 has, for example, a cylindrical shape and is provided with a connection hole 30*a*, into which the rotary shaft 4*a* of the fan motor 4 is inserted and fixed, at the central portion thereof, serving as the center of rotation of the rotation-axis part 30. Although the rotation-axis part 30 projects on the pressure surface 31*a* side of the blades 31 in Embodiment 1, the rotation-axis part 30 does not need to project on the pressure surface 31*a* side of the blades 31.

Hereinbelow, the "center of rotation" means the center of rotation of the propeller fan 3, that is, the center of rotation of the rotation-axis part 30. Furthermore, the direction of the center of rotation means the direction in which the center of rotation of the rotation-axis part 30 extends, in other words, the direction in which the connection hole 30*a* extends.

The plurality of blades 31 are disposed at equal angles around the rotation-axis part 30 in the circumferential direction of the rotation-axis part 30. The adjoining blades 31 is joined at a leading edge 31*b* to a trailing edges 31*c* of an adjoining blade. In other words, the propeller fan 3 according to Embodiment 1 is a so-called integrated-wing propeller fan. Although the propeller fan 3 according to Embodiment 1 has three blades 31, the number of the blades 31 is not limited to three. Furthermore, the blades 31 may be disposed at different angles around the rotation-axis part 30.

Furthermore, the propeller fan 3 according to Embodiment 1 has a first rib 32 and second ribs 33 around the rotation-axis part 30. The rotation-axis part 30, the first rib 32, and the second ribs 33 constitute a hub of the propeller fan 3. The propeller fan 3 according to Embodiment 1 also has reinforcing ribs 34 and third ribs 35 to further improve at least one of the air diffusion effect and the strength. The reinforcing ribs 34 and the third ribs 35 of the propeller fan 3 may be omitted.

The first rib 32 is provided on the pressure surfaces 31*a* of the plurality of blades 31. Furthermore, the first rib 32 projects in the direction of the center of rotation and surrounds the rotation-axis part 30. In other words, the first rib 32 projects toward the downstream side in the airflow direction and surrounds the rotation-axis part 30. More specifically, the first rib 32 according to Embodiment 1 has three ribs 32*a* having arc-shaped outer circumferential surfaces as viewed in the axial direction of the rotation-axis part. In other words, the outer circumferential surfaces of the ribs 32*a* have a curved shape. The ribs 32*a* are disposed at equal angles around the rotation-axis part 30 in the circumferential direction of the rotation-axis part 30. Furthermore, the adjoining ribs 32*a* are joined to one another at ends thereof. Hence, the first rib 32 according to Embodiment 1 surrounds the rotation-axis part 30 such that the outer circumferential surface thereof forms a substantially triangle shape when the first rib 32 is viewed in the axial direction of the rotation-axis part. Note that the ribs 32*a* constituting the first rib 32 have a substantially uniform thickness between the ends thereof when viewed in the axial direction of the rotation-axis part. In other words, the first rib 32 has a substantially uniform thickness over the entire circumference. Hence, the inner circumferential surface of the first rib 32 also has a substantially triangle shape when the first rib 32 is viewed in the axial direction of the rotation-axis part. In other words, the first rib 32 surrounds the rotation-axis part 30 to form a substantially triangle shape when the first rib 32 is viewed in the axial direction of the rotation-axis part.

When the propeller fan 3 rotates, the first rib 32 diffuses the air therearound. As a result of being attracted of the diffused air to the main flow generated by the propeller fan 3, which flows on the outer circumferential side of the blades 31, it is possible to diffuse the main flow generated by the propeller fan 3 toward the inner circumferential side. In other words, it is possible to diffuse the main flow generated by the propeller fan 3 to the vicinity of the outer circumferential part of the first rib 32.

Furthermore, the third rib 35 is provided at one end of each rib 32*a* constituting the first rib 32 and extends along the rib 32*a* toward the outer circumferential side of the first rib 32. Specifically, the third ribs 35 are provided on the pressure surfaces 31*a* of the blades 31, and the third ribs 35 project in the direction of the center of rotation and extends from the first rib 32 toward the outer circumferential side. In other words, the third ribs 35 project toward the downstream side in the airflow direction and extends from the first rib 32 toward the outer circumferential side. By providing the third ribs 35, it is possible to further diffuse the air around the first rib 32 when the propeller fan 3 rotates, thus allowing the main flow generated by the propeller fan 3 to further diffuse toward the inner circumferential side.

Figure 9:
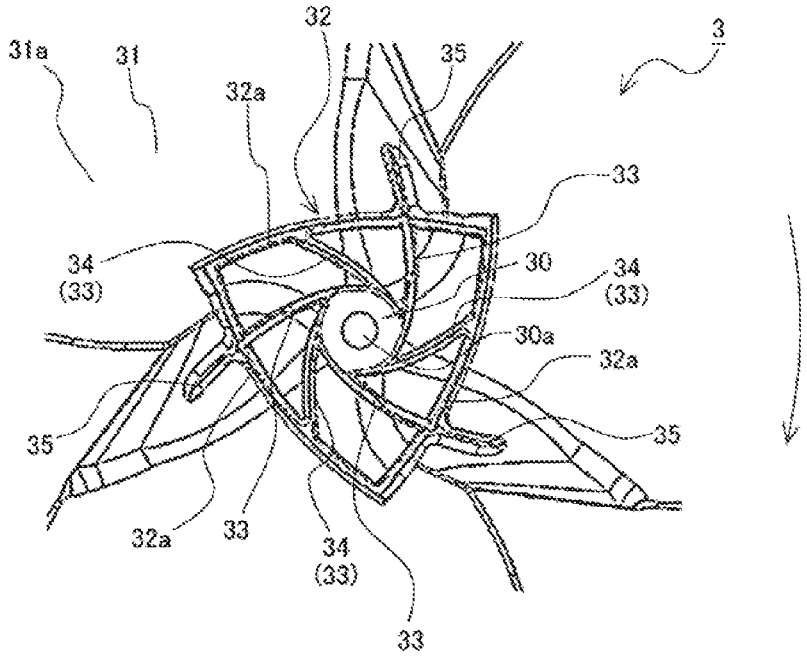
FIG. 9 is a front view of another example of the rotation-axis part and the vicinity thereof of the propeller fan according to Embodiment 1 of the present invention.
Figure 10:
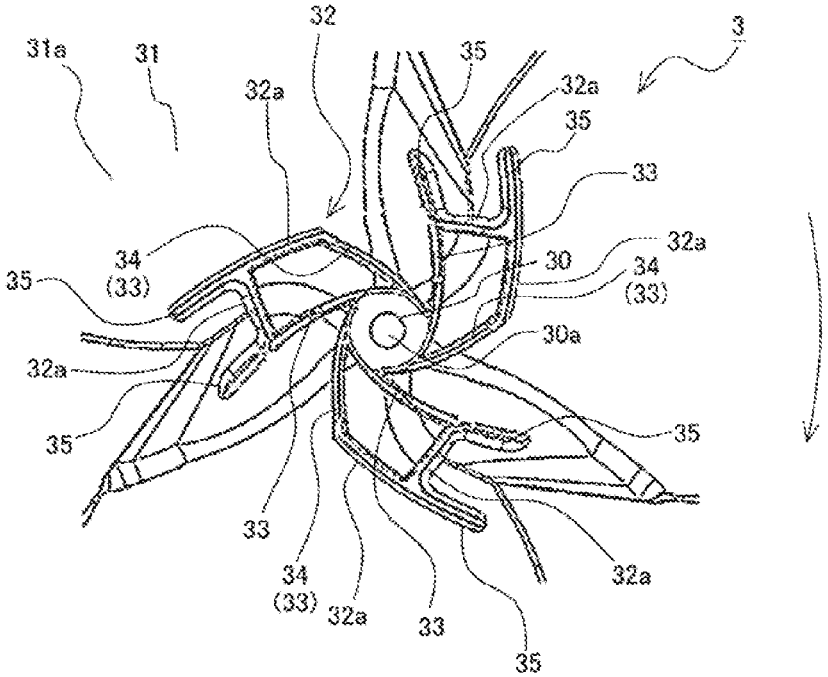
FIG. 10 is a front view of another example of the rotation-axis part and the vicinity thereof of the propeller fan according to Embodiment 1 of the present invention.

Herein, the number of the ribs 32*a* constituting the first rib 32 is not limited to three. The ribs 32*a* may be disposed at different angles around the rotation-axis part 30 and may be disposed at different distances from the rotation-axis part 30. Furthermore, the ribs 32*a* may have different lengths when the first rib 32 is viewed in the axial direction of the rotation-axis part. The third ribs 35 provided at the ends of the ribs 32*a* may be omitted, and, for example, the third ribs 35 do not need to be provided at the ends of the ribs 32*a*, as shown in FIG. 9. Furthermore, the first rib 32 does not need to completely surround the rotation-axis part 30. For example, as shown in FIG. 10, portions of the first rib 32 may be removed. In Embodiment 1, the expression "the first rib 32 surrounds the rotation-axis part 30" is used also when portions of the first rib 32 are removed.

Note that FIGS. 9 and 10 are front views of other examples of the rotation-axis part and the vicinity thereof of the propeller fan according to Embodiment 1 of the present invention.

The second ribs 33 are provided on the pressure surfaces 31*a* of the plurality of blades 31. The second ribs 33 project in the direction of the center of rotation and extends from the rotation-axis part 30 toward the first rib 32. In other words, the second ribs 33 project toward the downstream side in the airflow direction and extends from the rotation-axis part 30 toward the first rib 32. More specifically, in Embodiment 1, three second ribs 33 are provided. The second ribs 33 are disposed at equal angles around the rotation-axis part 30, in the circumferential direction of the rotation-axis part 30. In other words, the second ribs 33 extend substantially radially from the rotation-axis part 30.

When the propeller fan 3 rotates, the second ribs 33 diffuse the air therearound. As a result of being attracted of the diffused air to the main flow generated by the propeller fan 3, which has been diffused by the first rib 32 to the vicinity of the outer circumferential part of the first rib 32, it is possible to diffuse the main flow generated by the propeller fan 3 to the downstream side of the rotation-axis part 30. In other words, it is possible to generate a sufficient airflow on the downstream side of the rotation-axis part 30.

Furthermore, a third rib 35 is provided at the outer circumferential end of each second rib 33 and extends along the second rib 33 toward the outer circumferential side of the first rib 32. As has been described above, by providing the third ribs 35, it is possible to further diffuse the air around the first rib 32 when the propeller fan 3 rotates, thus allowing the main flow generated by the propeller fan 3 to further diffuse toward the inner circumferential side.

Herein, as shown in FIG. 7, downstream ends 33*a* of the second ribs 33 are located on the downstream side of a downstream end 32*b* of the first rib 32 in the airflow direction. In other words, among the ends of the second ribs 33 in the direction of the center of rotation, the downstream ends 33*a*, which are distant from the pressure surfaces 31*a*, project in the direction away from the pressure surfaces 31*a* farther than the downstream end 32*b* of the first rib 32, which is distant from the pressure surfaces 31*a*, among the ends of the first rib 32 in the direction of the center of rotation. By providing the downstream ends 33*a* of the second ribs 33 at these positions, it is possible to further diffuse the air around the second ribs 33, thus allowing more sufficient airflow to be generated on the downstream side of the rotation-axis part 30.

Figure 11:
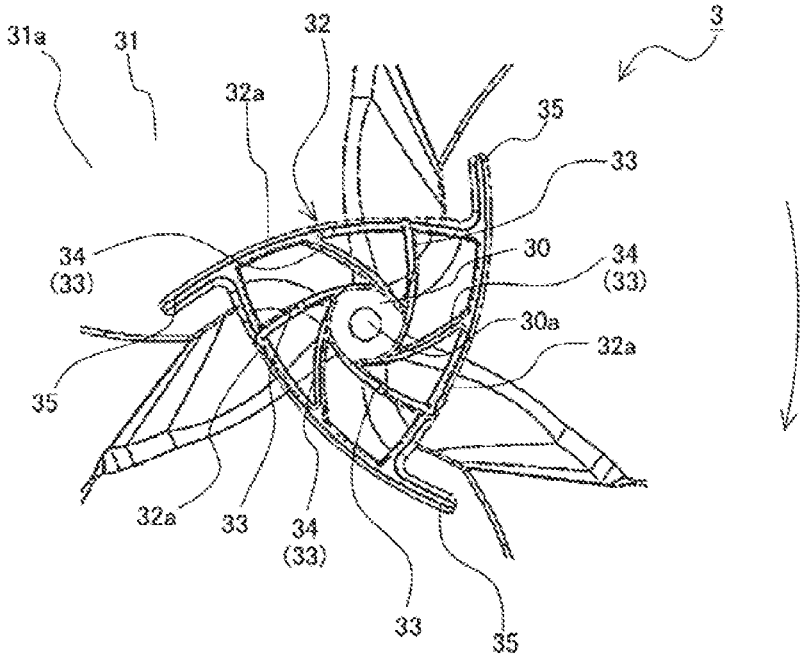
FIG. 11 is a front view of another example of the rotation-axis part and the vicinity thereof of the propeller fan according to Embodiment 1 of the present invention.

The number of the second ribs 33 is not limited to three. The second ribs 33 may be disposed at different angles around the rotation-axis part 30. Furthermore, the third ribs 35 provided at the outer circumferential ends of the second ribs 33 may be omitted, and, for example, the third ribs 35 do not need to be provided at the outer circumferential ends of the second ribs 33, as shown in FIG. 11. Furthermore, the inner circumferential ends of the second ribs 33 do not need to be joined to the rotation-axis part 30. Furthermore, as shown in FIG. 12, the outer circumferential ends of the second ribs 33 do not need to be joined to the first rib 32.

Figure 12:
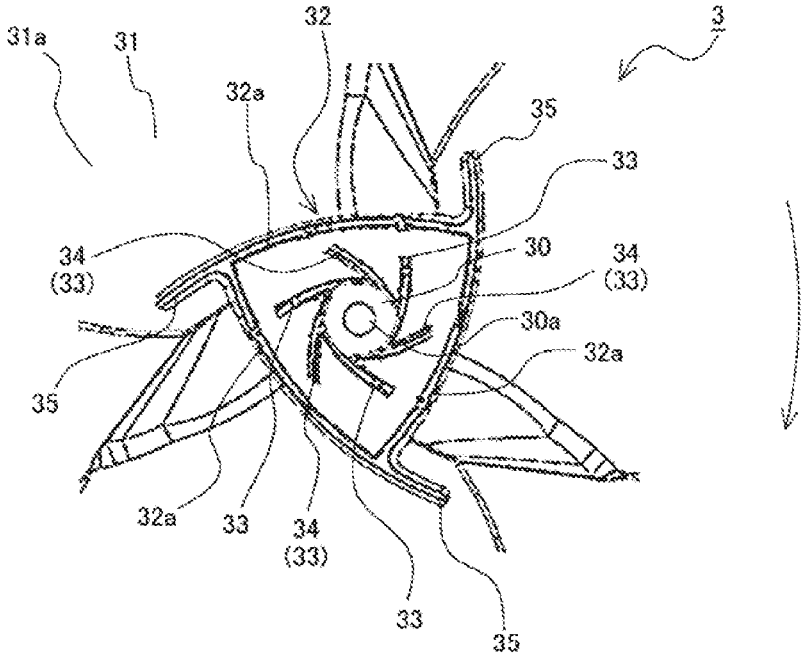
FIG. 12 is a front view of another example of the rotation-axis part and the vicinity thereof of the propeller fan according to Embodiment 1 of the present invention.

Note that FIGS. 11 and 12 are front views of other examples of the rotation-axis part and the vicinity thereof of the propeller fan according to Embodiment 1 of the present invention.

The reinforcing ribs 34 may be omitted. The reinforcing ribs 34 are provided on the pressure surfaces 31*a* of the blades 31 when the strength of the hub constituted of the rotation-axis part 30, the first rib 32, and the second ribs 33 is to be further improved. In that case, for example, the reinforcing ribs 34 may be formed as shown in FIG. 8. The reinforcing ribs 34 shown in FIG. 8 project in the direction of the center of rotation and extend from the rotation-axis part 30 toward the first rib 32. By forming the reinforcing ribs 34 in this manner, it is possible to make the reinforcing ribs 34 also function as the second ribs 33. In other words, the strength of the hub may be improved by increasing the number of the second ribs 33.

Figure 13:
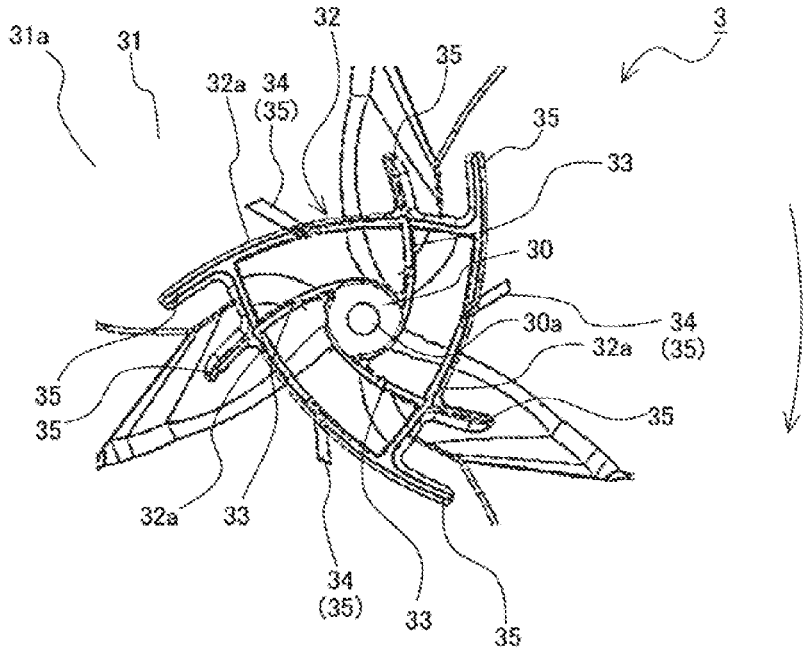
FIG. 13 is a front view of another example of the rotation-axis part and the vicinity thereof of the propeller fan according to Embodiment 1 of the present invention.
Figure 14:
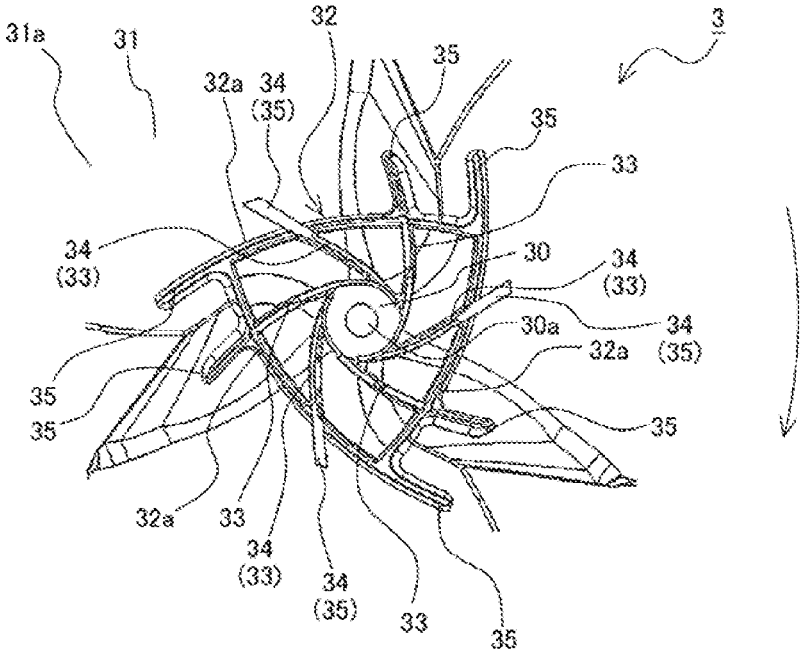
FIG. 14 is a front view of another example of the rotation-axis part and the vicinity thereof of the propeller fan according to Embodiment 1 of the present invention.

Alternatively, for example, the reinforcing ribs 34 may be formed as shown in FIG. 13. The reinforcing ribs 34 shown in FIG. 13 project in the direction of the center of rotation and extend from the first rib 32 toward the outer circumferential side. By forming the reinforcing ribs 34 in this manner, it is possible to make the reinforcing ribs 34 also function as the third ribs 35. In other words, the strength of the hub may be improved by increasing the number of the third ribs 35. Alternatively, for example, as shown in FIG. 14, both the reinforcing ribs 34 shown in FIG. 8 and the reinforcing ribs 34 shown in FIG. 13 may be provided. Furthermore, for example, if the reinforcing ribs 34 do not have to perform an aerodynamic work, the shape of the reinforcing ribs 34 is not limited to the shape described above and may have any rib shape. For example, as shown in FIG. 15, the reinforcing ribs 34 may be formed to connect the first rib 32 and the second ribs 33, on the inner circumferential side of the first rib 32.

Figure 15:
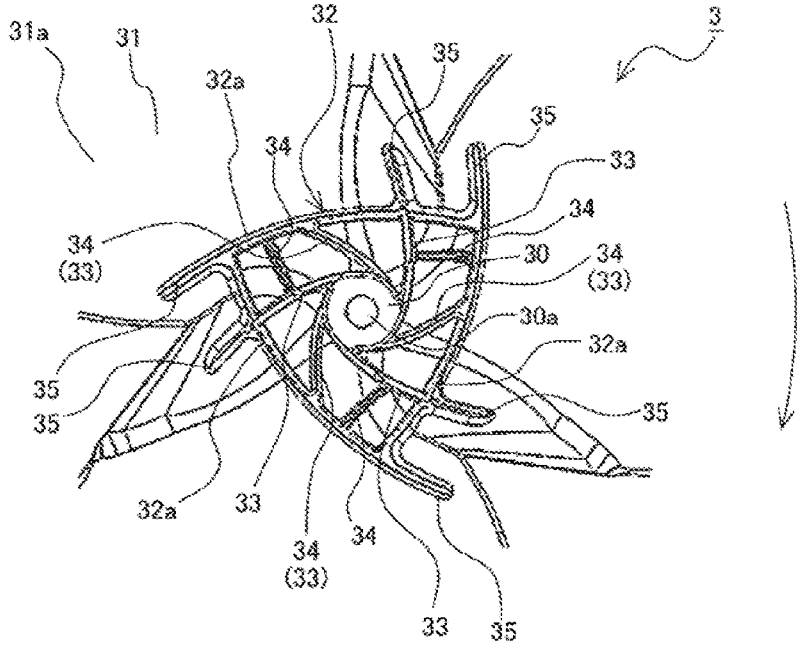
FIG. 15 is a front view of another example of the rotation-axis part and the vicinity thereof of the propeller fan according to Embodiment 1 of the present invention.

Note that FIGS. 13 to 15 are front views of other examples of the rotation-axis part and the vicinity thereof of the propeller fan according to Embodiment 1 of the present invention.

Next, an air-sending operation of the outdoor unit 100 according to Embodiment 1 will be described.

As indicated by arrows in FIG. 2, in the outdoor unit 100 according to Embodiment 1, when the propeller fan 3 rotates, air is taken into the outdoor unit body 1 from the outside of the outdoor unit body 1 through the air inlets 1*h* provided at the first side-surface part 1*a* and the back-surface part 1*d* of the outdoor unit body 1. The air taken into the outdoor unit body 1 passes through the heat exchanger 8 disposed along the air inlets 1*h*. As a result, the air and the refrigerant in the heat exchanger 8 exchange heat. The air that has exchanged heat in the heat exchanger 8 passes through the propeller fan 3 and the bell mouth 9 and is blown outdoors through the air outlet 1*g*. At this time, as shown in FIG. 2, an airflow A that is blown outdoors through the air outlet 1*g* is generated.

In a related-art propeller fan, the main flow of the airflow generated when the propeller fan rotates flows on the outer circumferential side of the blades. Hence, in the related-art propeller fan, not a large part of the airflow A blown outdoors through the air outlet provided at the outdoor unit flows on the downstream side of the rotation-axis part and stagnates, thus generating a large separation area on the downstream side of the rotation-axis part. On the other hand, the propeller fan 3 according to Embodiment 1 has the above-described first rib 32 and the second ribs 33. Hence, the airflow A blown outdoors through the air outlet 1*g* of the outdoor unit 100 can flow on the downstream side of the rotation-axis part 30, reducing the separation area generated on the downstream side of the rotation-axis part 30, compared with that in the related-art propeller fan.

Hereinbelow, with comparison between the outdoor unit 100 having the propeller fan 3 according to Embodiment 1 and an outdoor unit having a related-art propeller fan, how the propeller fan 3 and the outdoor unit 100 according to Embodiment 1 reduce the separation area will be described. Hereinbelow, when the related-art propeller fan and outdoor unit are described, the same components as those of the propeller fan 3 and the outdoor unit 100 according to Embodiment 1 will be denoted by the same reference signs as those in the propeller fan 3 and the outdoor unit 100 according to Embodiment 1, and the explanations thereof will be omitted.

Figure 16:
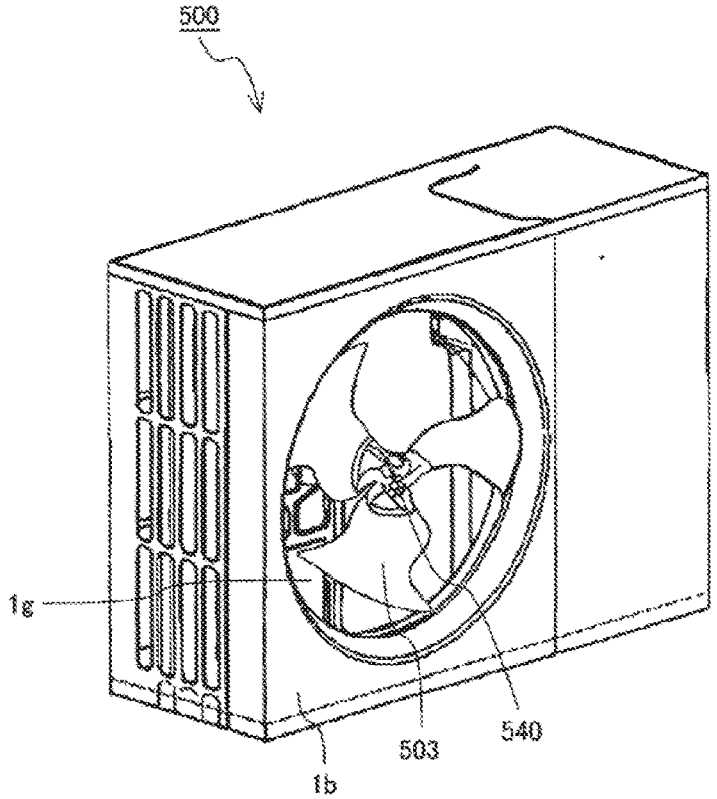
FIG. 16 is a perspective view of a related-art outdoor unit without a fan grille, as viewed from the front side.
Figure 17:
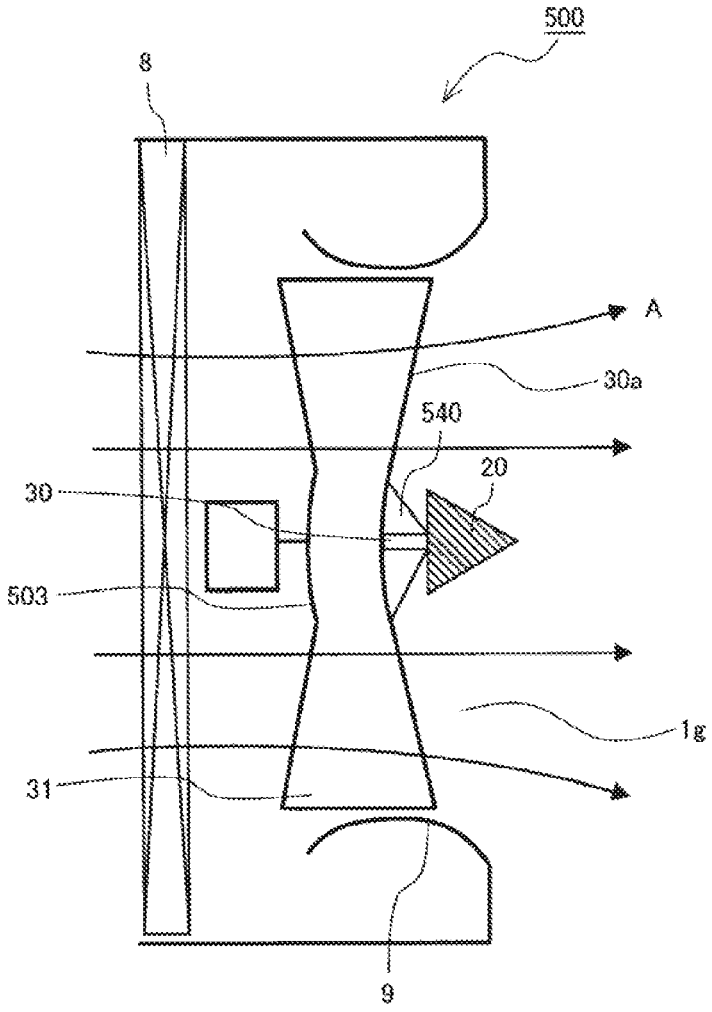
FIG. 17 is a schematic vertical sectional view of the related-art outdoor unit, as observed from the side, for explaining an airflow generated in the outdoor unit.

FIG. 16 is a perspective view of a related-art outdoor unit without a fan grille, as viewed from the front side. Furthermore, FIG. 17 is a schematic vertical sectional view of the related-art outdoor unit, as observed from the side, for explaining an airflow generated in the outdoor unit.

The related-art outdoor unit 500 differs from the outdoor unit 100 according to Embodiment 1 in the configuration of a propeller fan 503. More specifically, the related-art propeller fan 503 does not have the ribs (the first rib 32, the second ribs 33, the reinforcing ribs 34, and the third ribs 35) that are provided on the propeller fan 3 according to Embodiment 1. Instead of these ribs, the related-art propeller fan 503 has ribs 540. The ribs 540 are provided on the pressure surfaces 31*a* of the plurality of blades 31. The ribs 540 extend radially from the rotation-axis part 30 and have a shape projecting downstream in the airflow direction from the pressure surfaces 31*a*. The other configurations of the related-art outdoor unit 500 and the related-art propeller fan 503 are the same as those of the outdoor unit 100 and the propeller fan 3 according to Embodiment 1.

The main flow generated when the propeller fan 503 rotates flows on the outer circumferential side of the blades 31. At this time, because the propeller fan 503 has the ribs 540 extending radially from the rotation-axis part 30, the air near the outer circumferential ends of the ribs 540 are diffused. As a result of being attracted of the diffused air to the main flow, the main flow diffuses to the vicinity of the outer circumferential ends of the ribs 540. In other words, it is possible to cause the airflow A to flow to the vicinity of the outer circumferential ends of the ribs 540. However, the airflow A does not diffuse to the downstream side of the rotation-axis part 30. Hence, in the propeller fan 503, a large separation area 20 is generated on the downstream side of the rotation-axis part 30.

Figure 18:
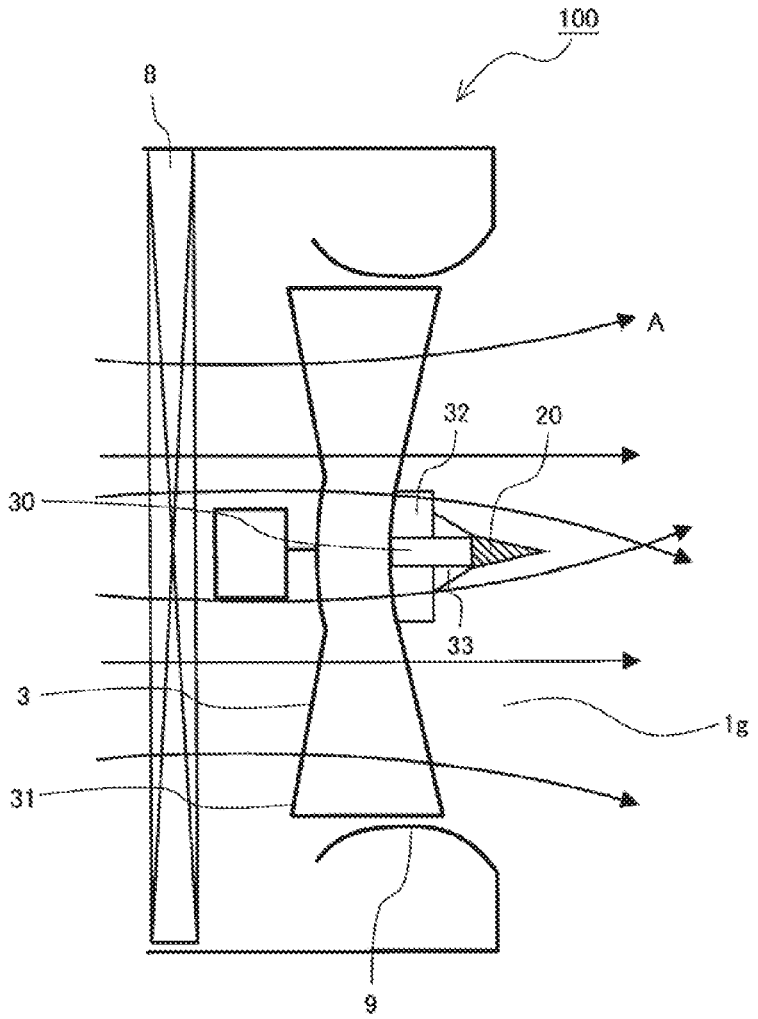
FIG. 18 is a schematic vertical sectional view of the outdoor unit according to Embodiment 1 of the present invention, as observed from the side, for explaining an airflow generated in the outdoor unit.

FIG. 18 is a schematic vertical sectional view of the outdoor unit according to Embodiment 1 of the present invention, as observed from the side, for explaining an airflow generated in the outdoor unit.

The main flow generated when the propeller fan 3 rotates also flows on the outer circumferential side of the blades 31. At this time, the first rib 32 of the propeller fan 3 diffuses the air therearound. As a result of being attracted of the diffused air to the main flow, it is possible to diffuse the main flow generated by the propeller fan 3 toward the inner circumferential side. In other words, it is possible to diffuse the airflow A to the vicinity of the outer circumferential part of the first rib 32. In addition, when the propeller fan 3 rotates, the second ribs 33 also diffuse the air therearound. As a result of being attracted of the diffused air to the airflow A, which has been diffused to the vicinity of the outer circumferential part of the first rib 32 by the first rib 32, it is possible to diffuse the airflow A to the downstream side of the rotation-axis part 30. In other words, it is possible to generate a sufficient amount of airflow A on the downstream side of the rotation-axis part 30. Hence, in the propeller fan 3, it is possible to make the separation area 20 generated on the downstream side of the rotation-axis part 30 sufficiently small.

As has been described above, because the propeller fan 3 according to Embodiment 1 has the first rib 32 and the second ribs 33 as described above, it is possible to make the separation area 20 generated on the downstream side of the rotation-axis part 30 sufficiently small. Hence, in the propeller fan 3 according to Embodiment 1, it is possible to suppress the creation of a vortex on the downstream side of the rotation-axis part 30. As a result, in the propeller fan 3 according to Embodiment 1, it is possible to suppress a decrease in the pressure-flow characteristics due to the creation of a vortex. Furthermore, in the propeller fan 3 according to Embodiment 1, it is possible to reduce the noise caused by the creation of a vortex.

Furthermore, the propeller fan 3 according to Embodiment 1 has the third ribs 35 extending toward the outer circumferential side of the first rib 32. Hence, in the propeller fan 3 according to Embodiment 1, it is possible to further diffuse the airflow A generated by the propeller fan 3 toward the inner circumferential side. Hence, in the propeller fan 3 according to Embodiment 1, it is possible to further suppress a decrease in the pressure-flow characteristics due to the creation of a vortex and, thus, to further reduce the noise caused by the creation of a vortex.

Furthermore, the outdoor unit 100 according to Embodiment 1 includes the above-described propeller fan 3 and the heat exchanger 8. Accordingly, in the outdoor unit 100 according to Embodiment 1, it is possible to make the separation area 20 generated on the downstream side of the rotation-axis part 30 of the propeller fan 3 sufficiently small. Hence, in the outdoor unit 100 according to Embodiment 1, it is possible to suppress the creation of a vortex on the downstream side of the rotation-axis part 30. Accordingly, it is possible to obtain the outdoor unit 100 in which a decrease in the pressure-flow characteristics due to the creation of a vortex is suppressed. Furthermore, it is possible to obtain the outdoor unit 100 in which the noise caused by the creation of a vortex is reduced.

Embodiment 2

In the propeller fan 3 according to Embodiment 1, the first rib 32 is formed of a plurality of ribs 32*a* having outer circumferential surfaces formed in a curved shape and having a substantially uniform thickness. In the propeller fan 3 according to Embodiment 1, the first rib 32 surrounds the rotation-axis part 30 to have a substantially polygonal shape when the first rib 32 is viewed in the axial direction of the rotation-axis part. However, the shape of the first rib 32 surrounding the rotation-axis part 30 is not limited to the shape described in Embodiment 1. For example, the first rib 32 may surround the rotation-axis part 30 in a manner described below. Note that, in Embodiment 2, components that are not specifically described have the same configurations as those in Embodiment 1, and the same functions and configurations will be described by using the same reference signs.

Figure 19:
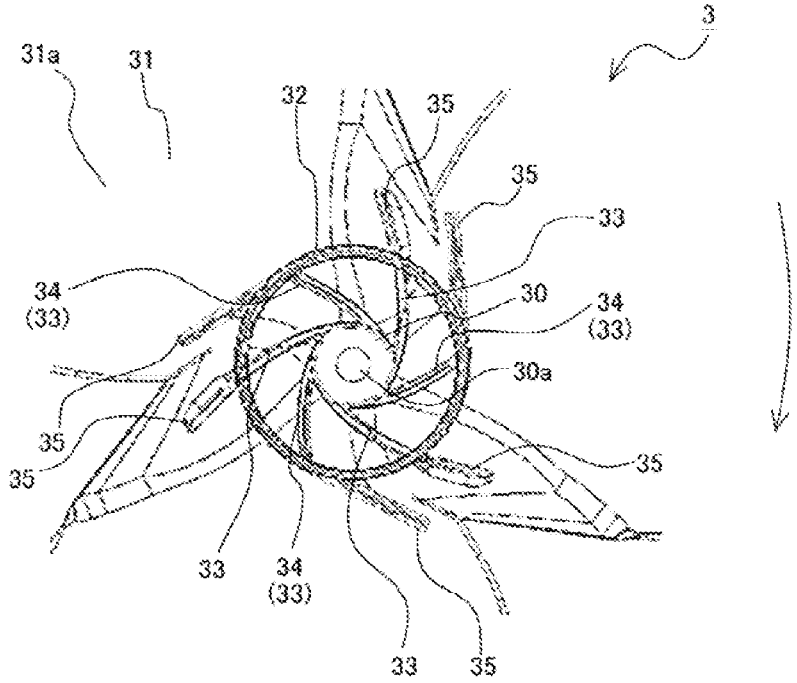
FIG. 19 is a front view of an example of a rotation-axis part and the vicinity thereof of a propeller fan according to Embodiment 2 of the present invention.

FIG. 19 is a front view of an example of the rotation-axis part and the vicinity thereof of a propeller fan according to Embodiment 2 of the present invention. For example, as shown in FIG. 19, the first rib 32 may have a circular outer circumferential surface when the first rib 32 surrounding the rotation-axis part 30 is viewed in the axial direction of the rotation-axis part. In other words, the first rib 32 shown in FIG. 19 has two ribs having arc-shaped outer circumferential surfaces when viewed in the axial direction of the rotation-axis part, and the rotation-axis part 30 is surrounded by these ribs. Similarly to the first rib 32 described in Embodiment 1, the first rib 32 shown in FIG. 19 has a substantially uniform thickness when viewed in the axial direction of the rotation-axis part.

Also in the propeller fan 3 in which the first rib 32 is configured as shown in FIG. 19, the first rib 32 diffuses the air therearound as the propeller fan 3 rotates. Hence, it is possible to diffuse the airflow A to the vicinity of the outer circumferential part of the first rib 32. In addition, because the second ribs 33 also diffuses the air therearound, it is possible to diffuse the airflow A to the downstream side of the rotation-axis part 30. Accordingly, also in the propeller fan 3 shown in FIG. 19, it is possible to generate a sufficient amount of airflow A on the downstream side of the rotation-axis part 30 and, thus, to make the separation area 20 generated on the downstream side of the rotation-axis part 30 sufficiently small.

Hence, also in the propeller fan 3 shown in FIG. 19, similarly to that in Embodiment 1, it is possible to suppress the creation of a vortex on the downstream side of the rotation-axis part 30. Accordingly, also in the propeller fan 3 shown in FIG. 19, similarly to that in Embodiment 1, it is possible to suppress a decrease in the pressure-flow characteristics due to the creation of a vortex and to reduce the noise caused by the creation of a vortex.

Comparing the propeller fan 3 shown in FIG. 19 with the propeller fan 3 according to Embodiment 1, the configuration of the first rib 32 shown in Embodiment 1 can further improve the strength of the propeller fan 3. In other words, when the propeller fan 3 shown in FIG. 19 and the propeller fan 3 according to Embodiment 1 are formed to have the same strength, the propeller fan 3 according to Embodiment 1 is lighter.

Furthermore, comparing the propeller fan 3 shown in FIG. 19 with the propeller fan 3 according to Embodiment 1, the outer circumferential surface of the first rib 32 of the propeller fan 3 according to Embodiment 1 has a larger angle with respect to the rotation direction of the propeller fan 3. Hence, comparing the propeller fan 3 shown in FIG. 19 with the propeller fan 3 according to Embodiment 1, the first rib 32 of the propeller fan 3 according to Embodiment 1 can more efficiently diffuse the air therearound. Accordingly, comparing the propeller fan 3 shown in FIG. 19 with the propeller fan 3 according to Embodiment 1, the propeller fan 3 according to Embodiment 1 can achieve higher power and better aerodynamic characteristics.

Furthermore, the propeller fan 3 according to Embodiment 1 also has an advantage in that it can reduce the noise, compared with the propeller fan 3 shown in FIG. 19. More specifically, in the propeller fan 3 according to Embodiment 1, the first rib 32 has a substantially polygonal outer circumferential surface. Assuming that the number of sides (in other words, corners) of this polygonal shape is n, when the propeller fan 3 according to Embodiment 1 rotates, a noise in which peaks occur at a frequency that is n times the rotation frequency of the propeller fan 3 is generated. In other words, the noise generated by the propeller fan 3 according to Embodiment 1 is an n-order noise. Hence, in the propeller fan 3 according to Embodiment 1, it is also possible to reduce the noise by determining the number, n, of the sides (in other words, corners) in the polygonal shape such that parts around the propeller fan 3 are not resonated by the noise of the propeller fan 3.

Figure 20:
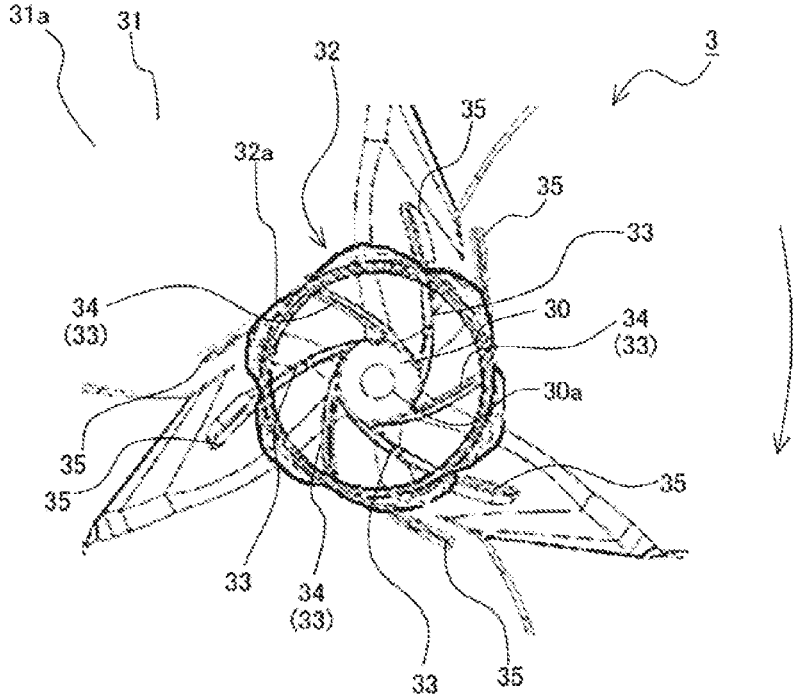
FIG. 20 is a front view of another example of the rotation-axis part and the vicinity thereof of the propeller fan according to Embodiment 2 of the present invention.

FIG. 20 is a front view of another example of the rotation-axis part and the vicinity thereof of the propeller fan according to Embodiment 2 of the present invention. For example, as shown in FIG. 20, the first rib 32 has four or more ribs 32*a* having arc-shaped outer circumferential surfaces as viewed in the axial direction of the rotation-axis part. The ribs 32*a* are joined to one another and surround the rotation-axis part 30.

Also in the propeller fan 3 having the first rib 32 configured as shown in FIG. 20, the first rib 32 diffuses the air therearound as the propeller fan 3 rotates. Hence, it is possible to diffuse the airflow A to the vicinity of the outer circumferential part of the first rib 32. In addition, because the second ribs 33 also diffuses the air therearound, it is possible to diffuse the airflow A to the downstream side of the rotation-axis part 30. Accordingly, also in the propeller fan 3 shown in FIG. 20, it is possible to generate a sufficient amount of airflow A on the downstream side of the rotation-axis part 30 and, thus, to make the separation area 20 generated on the downstream side of the rotation-axis part 30 sufficiently small.

Hence, also in the propeller fan 3 shown in FIG. 20, similarly to that in Embodiment 1, it is possible to suppress the creation of a vortex on the downstream side of the rotation-axis part 30. Accordingly, also in the propeller fan 3 shown in FIG. 20, similarly to that in Embodiment 1, it is possible to suppress a decrease in the pressure-flow characteristics due to the creation of a vortex and to reduce the noise caused by the creation of a vortex.

Comparing the propeller fan 3 shown in FIG. 19 with the propeller fan 3 shown in FIG. 20, the outer circumferential surface of the first rib 32 of the propeller fan 3 shown in FIG. 20 has a larger angle with respect to the rotation direction of the propeller fan 3, similarly to the propeller fan 3 according to Embodiment 1. Hence, comparing the propeller fan 3 shown in FIG. 19 with the propeller fan 3 shown in FIG. 20, the first rib 32 of the propeller fan 3 shown in FIG. 20 more efficiently diffuses the air therearound, similarly to the propeller fan 3 according to Embodiment 1. Accordingly, comparing the propeller fan 3 shown in FIG. 19 with the propeller fan 3 shown in FIG. 20, the propeller fan 3 shown in FIG. 20 can achieve higher power and better aerodynamic characteristics, similarly to the propeller fan 3 according to Embodiment 1.

Furthermore, compared with the propeller fan 3 shown in FIG. 19, the propeller fan 3 shown in FIG. 20 also has an advantage in that it can reduce noise, similarly to the propeller fan 3 according to Embodiment 1. More specifically, in the propeller fan 3 shown in FIG. 20, the number of arcs on the outer circumferential surface of the first rib 32 is defined as n. In this case, when the propeller fan 3 shown in FIG. 20 rotates, a noise in which peaks occur at a frequency that is n times the rotation frequency of the propeller fan 3 is generated. In other words, the noise generated by the propeller fan 3 shown in FIG. 20 is an n-order noise. Hence, in the propeller fan 3 shown in FIG. 20, it is also possible to reduce the noise by determining the number, n, of the arcs such that the parts around the propeller fan 3 are not resonated by the noise of the propeller fan 3.

Embodiment 3

The first ribs 32 of the propeller fans 3 according to Embodiments 1 and 2 are formed of the ribs 32*a* having curved outer circumferential surfaces. However, the configuration is not limited thereto, and the present invention may also be implemented by forming the outer circumferential surfaces of the ribs 32*a* constituting the first rib 32 in a planar shape. Note that, in Embodiment 3, components that are not specifically described have the same configurations as those in Embodiment 1 or 2, and the same functions and configurations will be described by using the same reference signs.

Figure 21:
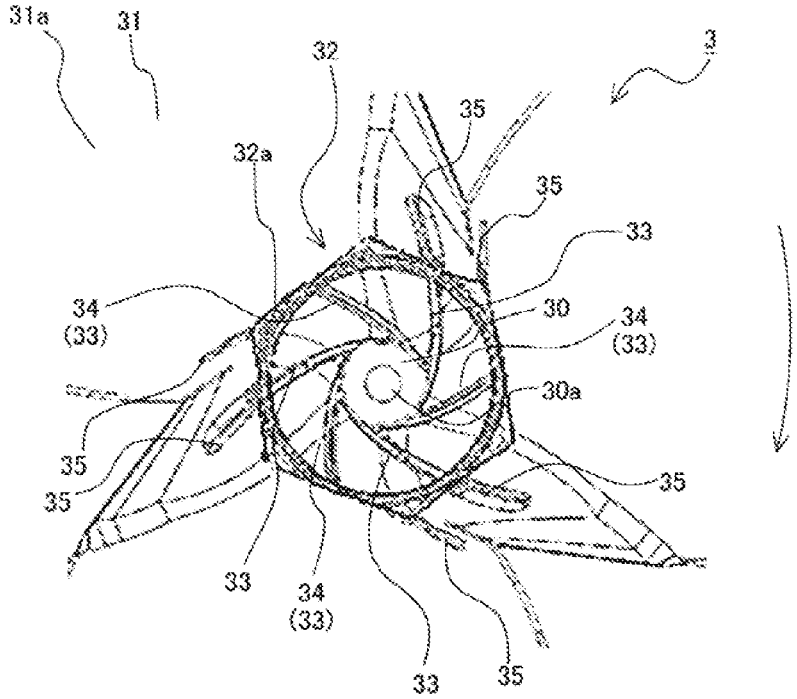
FIG. 21 is a front view of an example of a rotation-axis part and the vicinity thereof of a propeller fan according to Embodiment 3 of the present invention.

FIG. 21 is a front view of an example of a rotation-axis part and the vicinity thereof of a propeller fan according to Embodiment 3 of the present invention.

The first rib 32 according to Embodiment 3 has a plurality of ribs 32*a* having linear outer circumferential surfaces when viewed in the axial direction of the rotation-axis part. In other words, the ribs 32*a* have planar outer circumferential surfaces. Furthermore, ends of the adjoining ribs 32*a* are joined to one another. Hence, the first rib 32 according to Embodiment 3 surrounds the rotation-axis part 30 such that the outer circumferential surface thereof has a polygonal shape when the first rib 32 is viewed in the axial direction of the rotation-axis part.

Also in the propeller fan 3 in which the first rib 32 is configured as described in Embodiment 3, the first rib 32 diffuses the air therearound as the propeller fan 3 rotates. Hence, it is possible to diffuse the airflow A to the vicinity of the outer circumferential part of the first rib 32. In addition, because the second ribs 33 also diffuses the air therearound, it is possible to diffuse the airflow A to the downstream side of the rotation-axis part 30. Accordingly, also in the propeller fan 3 according to Embodiment 3, it is possible to generate a sufficient amount of airflow A on the downstream side of the rotation-axis part 30 and, thus, to make the separation area 20 generated on the downstream side of the rotation-axis part 30 sufficiently small.

Hence, also in the propeller fan 3 according to Embodiment 3, similarly to those according to Embodiments 1 and 2, it is possible to suppress the creation of a vortex on the downstream side of the rotation-axis part 30. Accordingly, in the propeller fan 3 according to Embodiment 3, similarly to those according to Embodiments 1 and 2, it is possible to suppress a decrease in the pressure-flow characteristics due to the creation of a vortex and to reduce the noise caused by the creation of a vortex.

Compared with the propeller fan 3 shown in FIG. 19, in the propeller fan 3 according to Embodiment 3, the outer circumferential surface of the first rib 32 of the propeller fan 3 has a large angle with respect to the rotation direction of the propeller fan 3, similarly to the propeller fan 3 according to Embodiment 1. Hence, comparing the propeller fan 3 shown in FIG. 19 with the propeller fan 3 according to Embodiment 3, the first rib 32 of the propeller fan 3 according to Embodiment 3 can more efficiently diffuse the air therearound, similarly to the propeller fan 3 according to Embodiment 1. Accordingly, comparing the propeller fan 3 shown in FIG. 19 with the propeller fan 3 according to Embodiment 3, the propeller fan 3 according to Embodiment 3 can achieve higher power and better aerodynamic characteristics, similarly to the propeller fan 3 according to Embodiment 1.

Furthermore, compared with the propeller fan 3 shown in FIG. 19, the propeller fan 3 according to Embodiment 3 also has an advantage in that it can reduce the noise, similarly to the propeller fan 3 according to Embodiment 1. More specifically, in the propeller fan 3 according to Embodiment 3, the number of sides of a polygon formed by the outer circumferential surface of the first rib 32 is defined as n. In this case, when the propeller fan 3 according to Embodiment 3 rotates, a noise in which peaks occur at a frequency that is n times the rotation frequency of the propeller fan 3 is generated. In other words, the noise generated by the propeller fan 3 according to Embodiment 3 is an n-order noise. Hence, in the propeller fan 3 according to Embodiment 3, it is also possible to reduce the noise by determining the number, n, of the sides such that the parts around the propeller fan 3 are not resonated by the noise of the propeller fan 3.

Embodiment 4

In the case where the pressure generated on the upstream side or the downstream side of the propeller fan 3 in the airflow direction when the propeller fan 3 rotates increases, such as when the fins of the heat exchanger 8 are clogged with dust or dirt, a flow directed in the direction opposite to the direction of the airflow A is generated in the area on the downstream side of the rotation-axis part 30 in the direction of the airflow A. In other words, a flow of the air in the area shown as the separation area 20 in FIGS. 17 and 18 flowing back toward the rotation-axis part 30 is generated. When such a backflow occurs, the airflow A diffuses toward the outer circumferential side of the propeller fan 3, creating a vortex in the area on the downstream side of the rotation-axis part 30 in the direction of the airflow A. Hence, a decrease in the pressure-flow characteristics due to the creation of the vortex increases, and the noise caused by the creation of the vortex also increases.

However, in the propeller fan 3 according to Embodiments 1 to 3, the downstream ends 33*a* of the second ribs 33 are located on the downstream side of the downstream end 32*b* of the first rib 32 in the direction of the airflow A. Hence, when the propeller fan 3 rotates, the air flowing back toward the rotation-axis part 30 can be directed toward the outer circumferential side, with the portions of the second ribs 33 projecting further toward the downstream side in the direction of the airflow A than the first rib 32. As a result of this sent-out air being attracted to the airflow A, it is possible to diffuse the airflow A toward the inner circumferential side. Accordingly, in the propeller fan 3 described in Embodiments 1 to 3, it is possible to suppress the creation of a vortex on the downstream side of the rotation-axis part 30, even when the pressure generated on the upstream side or the downstream side of the propeller fan 3 in the airflow direction when the propeller fan 3 rotates increases. Accordingly, in the propeller fan 3 described in Embodiments 1 to 3, it is possible to suppress a decrease in the pressure-flow characteristics due to the creation of a vortex and to reduce the noise caused by the creation of a vortex, even when the pressure generated on the upstream side or the downstream side of the propeller fan 3 in the airflow direction when the propeller fan 3 rotates increases.

As has been described, when the creation of a vortex caused by an increase in the pressure generated on the upstream side or the downstream side of the propeller fan 3 in the airflow direction is to be suppressed, the creation of the vortex can be more effectively suppressed by providing closing ribs 36 as described below. In Embodiment 4, components that are not specifically described have the same configurations as those in any one of Embodiments 1 to 3, and the same functions and configurations will be described by using the same reference signs.

Figure 22:
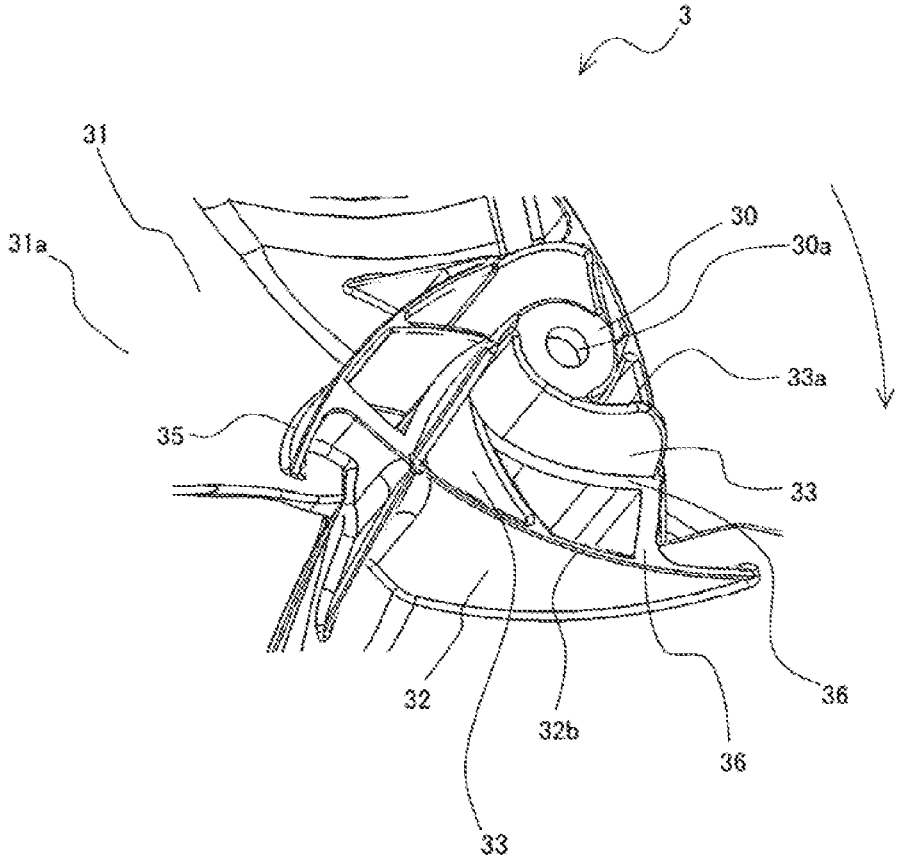
FIG. 22 is a perspective view of a rotation-axis part and the vicinity thereof of a propeller fan according to Embodiment 4 of the present invention, as viewed from the front side.
Figure 23:
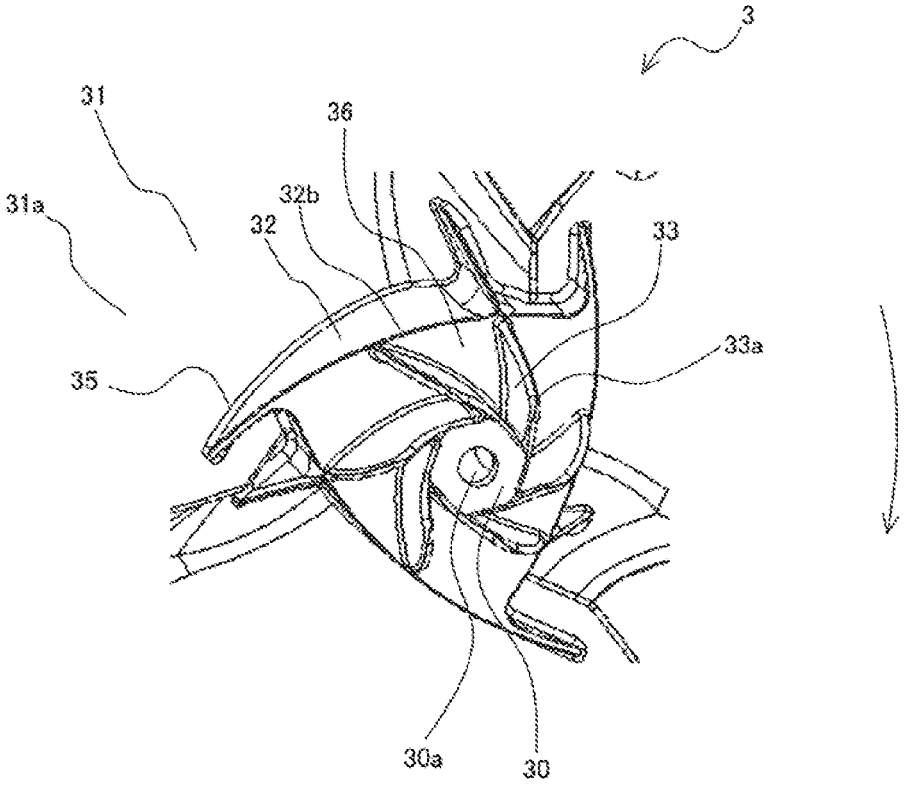
FIG. 23 is a perspective view of the rotation-axis part and the vicinity thereof of the propeller fan according to Embodiment 4 of the present invention, as viewed from the front side.

FIGS. 22 and 23 are perspective views of a rotation-axis part and the vicinity thereof of a propeller fan according to Embodiment 4 of the present invention, as viewed from the front side. In other words, FIGS. 22 and 23 are diagrams showing the rotation-axis part 30 of the propeller fan 3 and the vicinity thereof as viewed from the downstream side in the direction of the airflow A.

In the propeller fan 3 according to Embodiment 4, the downstream ends 33*a* of the second ribs 33 are located on the downstream side of the downstream end 32*b* of the first rib 32 in the direction of the airflow A. In other words, among the ends of the second ribs 33 in the direction of the center of rotation, the downstream ends 33*a* of the second ribs 33, which are distant from the pressure surfaces 31*a*, project in the direction away from the pressure surfaces 31*a* farther than the downstream end 32*b* of the first rib 32, which is distant from the pressure surfaces 31*a*, among the ends of the first rib 32 in the direction of the center of rotation.

Furthermore, the propeller fan 3 according to Embodiment 4 has the closing ribs 36 that close at least portions of spaces formed between the first rib 32 and the second ribs 33. The closing ribs 36 are disposed, for example, on a plane extending in a direction substantially perpendicular to the center of rotation from the downstream end 32*b* of the first rib 32. Note that FIG. 22 shows an example in which portions of the spaces formed between the first rib 32 and the second ribs 33 are closed by the closing ribs 36. More specifically, the propeller fan 3 shown in FIG. 22 includes the closing ribs 36 extending from the downstream end 32*b* of the first rib 32 toward the side surfaces of the second ribs 33 and the closing ribs 36 formed along the side surfaces of the second ribs 33 and projecting toward the first rib 32. Furthermore, FIG. 23 shows an example in which all the spaces formed between the first rib 32 and the second ribs 33 are closed by the closing ribs 36.

In the propeller fan 3 according to Embodiment 4, which has the closing ribs 36, when the air flowing back toward the rotation-axis part 30 as a result of an increase in the pressure generated on the upstream side or the downstream side of the propeller fan 3 in the airflow direction is to be directed toward the outer circumferential side with the second ribs 33, it is possible to prevent the air to be directed toward the outer circumferential side from colliding with the inner circumferential surface of the first rib 32, thus preventing failure to direct the air, which is to be directed toward the outer circumferential side, toward the outer circumferential side of the first rib 32. Accordingly, in the propeller fan 3 according to Embodiment 4, when the creation of a vortex caused by an increase in the pressure generated on the upstream side or the downstream side of the propeller fan 3 in the airflow direction is to be suppressed, it is possible to more effectively suppress the creation of a vortex, compared with a case where the closing ribs 36 are not provided.

Embodiment 5

In Embodiment 5, an example of a refrigeration cycle apparatus that has the propeller fan 3 described in Embodiments 1 to 4 will be described. In Embodiment 5, an example in which the refrigeration cycle apparatus is used as an air-conditioning apparatus will also be described. Note that, in Embodiment 5, components that are not specifically described have the same configurations as those in any one of Embodiments 1 to 4, and the same functions and configurations will be described by using the same reference signs.

Figure 24:
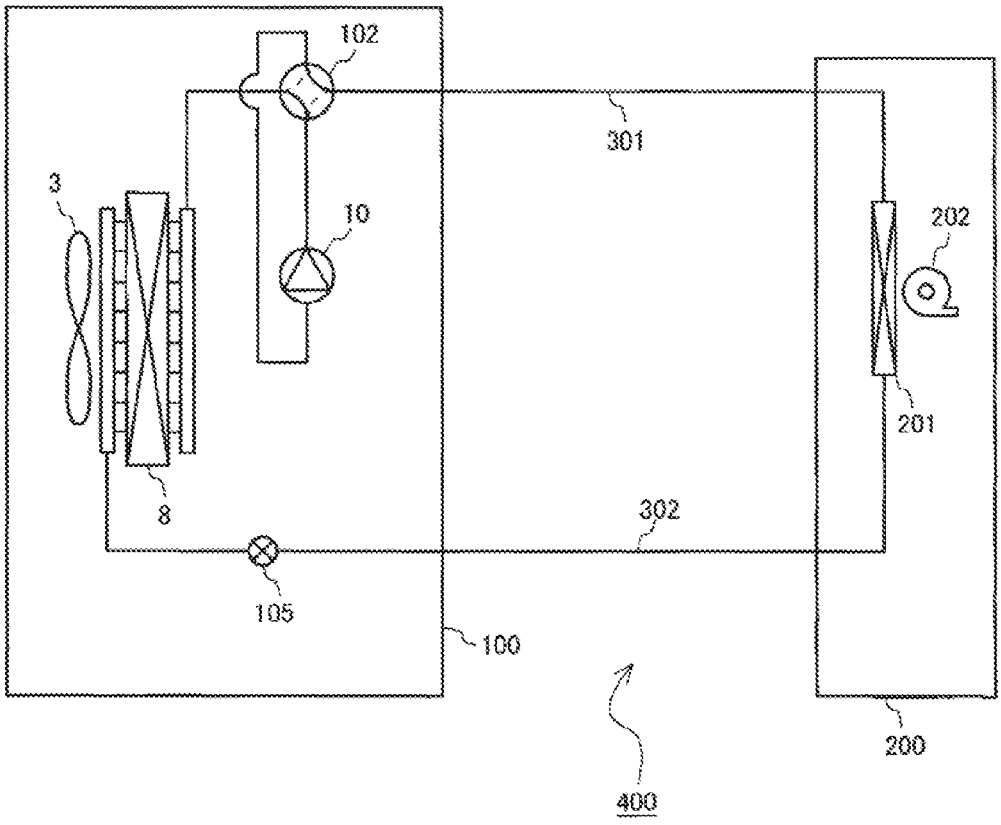
FIG. 24 shows the configuration of an air-conditioning apparatus according to Embodiment 5 of the present invention.

FIG. 24 shows the configuration of an air-conditioning apparatus according to Embodiment 5 of the present invention.

An air-conditioning apparatus 400 includes the outdoor unit 100 and an indoor unit 200. The components of the outdoor unit 100 and the components of the indoor unit 200 are connected by refrigerant pipes, forming a refrigerant circuit through which refrigerant circulates. Note that, in the refrigerant pipes connecting the components of the outdoor unit 100 and the components of the indoor unit 200, a pipe through which gaseous refrigerant (gas refrigerant) flows is referred to as a gas pipe 301, and a pipe through which liquid refrigerant (liquid refrigerant, or in some cases, gas-liquid two-phase refrigerant) flows is referred to as a liquid pipe 302.

The outdoor unit 100 includes, for example: a compressor 10; a four-way valve 102; a heat exchanger 8, serving as an outdoor heat exchanger; the propeller fan 3; and an expansion device 105, serving as, for example, an expansion valve.

The compressor 10 compresses and discharges the refrigerant taken therein. Herein, it is desirable that the compressor 10 include an inverter device and that the capacity of the compressor 10 (the amount of refrigerant discharged unit time) can be finely changed by appropriately changing the operating frequency. Based on the instruction from the control substrate 13, the four-way valve 102 switches the direction of flow of the refrigerant according to whether the cooling operation is performed or the heating operation is performed. Note that, if the air-conditioning apparatus 400 performs only one of the cooling operation and the heating operation, the four-way valve 102 is unnecessary.

The heat exchanger 8, serving as the outdoor heat exchanger, performs heat exchange between the refrigerant and the outdoor air. For example, during the heating operation, the heat exchanger 8 serves as an evaporator and performs heat exchange between the outdoor air and a low-pressure refrigerant flowing into the outdoor unit 100 from the liquid pipe 302 and decompressed by the expansion device 105, thus evaporating the refrigerant into gas. During the cooling operation, the heat exchanger 8 serves as a condenser and performs heat exchange between the outdoor air and the refrigerant flowing therein from the four-way valve 102 side and compressed in the compressor 10, thus condensing the refrigerant into liquid. The propeller fan 3 described in Embodiments 1 to 4 above is provided near the heat exchanger 8 to guide the outdoor air to the heat exchanger 8. As described in Embodiment 1, the fan motor 4 for rotationally driving the propeller fan 3 is connected to the propeller fan 3. The fan motor 4 may also be configured such that the operating frequency thereof can be appropriately changed by using an inverter device so that the rotation speed of the propeller fan 3 can be finely changed. The expansion device 105 is provided to adjust the pressure of the refrigerant or other factor by changing the opening degree.

On the other hand, the indoor unit 200 has a load-side heat exchanger 201 and a load-side fan 202. The load-side heat exchanger 201 performs heat exchange between the refrigerant and the indoor air. For example, during the heating operation, the load-side heat exchanger 201 serves as a condenser and performs heat exchange between the indoor air and the refrigerant flowing therein from the gas pipe 301, thus condensing the refrigerant into liquid (or gas-liquid two-phase fluid) and then discharging the fluid into the liquid pipe 302. During the cooling operation, the load-side heat exchanger 201 serves as an evaporator and performs heat exchange between the indoor air and the refrigerant that has been reduced in pressure by, for example, the expansion device 105, thus allowing the refrigerant to remove heat from the air to be evaporated into gas and discharging the gas toward the gas pipe 301 side. Furthermore, the indoor unit 200 is provided with the load-side fan 202 that guides the indoor air to the load-side heat exchanger 201. The operating speed of the load-side fan 202 is set by, for example, a user. Note that the propeller fan 3 described in Embodiments 1 to 4 may of course be used as the load-side fan 202.

The air-conditioning apparatus 400 according to Embodiment 5 has a refrigerant circuit that includes the condenser (one of the heat exchanger 8 and the load-side heat exchanger 201) and the evaporator (the other of the heat exchanger 8 and the load-side heat exchanger 201). More specifically, the refrigerant circuit according to Embodiment 5 includes the compressor 10, the condenser (one of the heat exchanger 8 and the load-side heat exchanger 201), the expansion device 105, and the evaporator (the other of the heat exchanger 8 and the load-side heat exchanger 201). The air-conditioning apparatus 400 according to Embodiment 5 has the propeller fan 3 described in Embodiments 1 to 4, which serves as a fan for guiding the air to the condenser or the evaporator. Accordingly, in the air-conditioning apparatus 400 according to Embodiment 5, it is possible to make the separation area 20 generated on the downstream side of the rotation-axis part 30 of the propeller fan 3 sufficiently small. Hence, in the air-conditioning apparatus 400 according to Embodiment 5, it is possible to suppress the creation of a vortex on the downstream side of the rotation-axis part 30 of the propeller fan 3. Accordingly, it is possible to obtain the air-conditioning apparatus 400 in which a decrease in the pressure-flow characteristics due to the creation of a vortex is suppressed. Furthermore, it is possible to obtain the air-conditioning apparatus 400 in which the noise caused by the creation of a vortex is reduced.

Herein, the refrigeration cycle apparatus having the propeller fan 3 described in Embodiments 1 to 4 does not necessarily have to be used in the air-conditioning apparatus 400. For example, the refrigeration cycle apparatus having the propeller fan 3 described in Embodiments 1 to 4 may be used as any of various devices and facilities, such as a water heater, that have a refrigerant circuit and a fan for supplying the air to the heat exchanger of the refrigerant circuit.

It should be considered that the embodiments disclosed herein are examples and are not limiting in all aspects. It is intended that the scope of the present invention is defined by the claims, not by the descriptions given above, and that the scope of the present invention includes all modifications that have equivalent meaning to the claims and that are within the scope of the claims.

REFERENCE SIGNS LIST

1 outdoor unit body, 1*a* first side-surface part, 1*b* front-surface part, 1*c* second side-surface part, 1*d* back-surface part, 1*e* top-surface part, 1*f* bottom-surface part, 1*g* air outlet, 1*h* air inlet, 2 fan grille, 3 propeller fan, 4 fan motor, 4*a* rotary shaft, 5 partition plate, 6 fan chamber, 7 machine chamber, 8 heat exchanger, 9 bell mouth, 10 compressor, 11 pipe, 12 board box, 13 control substrate, 20 separation area, 30 rotation-axis part, 30*a* connection hole, 31 blade, 31*a* pressure surface, 31*b* leading edge, 31*c* trailing edge, 32 first rib, 32*a* rib, 32*b* downstream-side end, 33 second rib, 33*a* downstream-side end, 34 reinforcing rib, 35 third rib, 36 closing rib, 100 outdoor unit, 102 four-way valve, 105 expansion device, 200 indoor unit, 201 load-side heat exchanger, 202 load-side fan, 301 gas pipe, 302 liquid pipe, 400 air-conditioning apparatus, 500 (related-art) outdoor unit, 503 (related-art) propeller fan, 540 (related-art) rib, A airflow

The invention claimed is:

1. A propeller fan comprising:

a rotation-axis part that serves as a center of rotation of the propeller fan; and a plurality of blades provided on an outer circumferential side of the rotation-axis part, each blade of the plurality of blades being joined at a leading edge of the blade to a trailing edge of an adjoining blade of the blades, the propeller fan having a first rib provided on pressure surfaces of the plurality of blades, the first rib projecting downstream in a main airflow direction of the propeller fan that is substantially parallel to an axis of rotation of the propeller fan and surrounding the rotation-axis part, and a plurality of second ribs provided on pressure surfaces of the plurality of blades, the plurality of second ribs projecting downstream in the main airflow direction and extending from the rotation-axis part toward the first rib, and wherein an axially downstream end of each second rib of the plurality of second ribs is located downstream of an axially downstream end of the first rib in the main airflow direction, and wherein the propeller fan further comprises closing ribs that close all of the spaces formed between the first rib and the plurality of second ribs, the closing ribs extending from the axially downstream end of the first rib and being disposed on a plane extending in a direction substantially perpendicular to the main airflow direction.

2. The propeller fan of claim 1, further comprising, on the pressure surfaces, a plurality of third ribs projecting downstream in the main airflow direction and extending from the first rib toward the outer circumferential side.

3. The propeller fan of claim 1, wherein the first rib has, as viewed from a downstream side in the main airflow direction, a circular outer circumferential surface.

4. The propeller fan of claim 1, wherein the first rib includes a plurality of ribs having arc-shaped outer circumferential surfaces as viewed from the downstream side in the main airflow direction, the plurality of ribs being configured to surround the rotation-axis part.

5. The propeller fan of claim 1, wherein the first rib has, as viewed from the downstream side in the main airflow direction, a polygonal outer circumferential surface.

6. An outdoor unit comprising:

the propeller fan of claim 1; and a heat exchanger configured to exchange heat with air guided by the propeller fan.

7. A refrigeration cycle apparatus comprising:

a refrigerant circuit having a condenser and an evaporator; and the propeller fan of claim 1, which serves as a fan for guiding air to the condenser or the evaporator.

8. The propeller fan of claim 4, wherein the plurality of ribs form a substantially triangular shape when viewed from the downstream side in the main airflow direction.

9. The propeller fan of claim 8, further comprising, on the pressure surfaces, a plurality of third ribs projecting downstream in the main airflow direction, each of the plurality of third ribs extending from an end of one of the plurality of ribs of the first rib toward the outer circumferential side.

10. The propeller fan of claim 1, wherein an outer circumferential end of each second rib of the plurality of second ribs is not directly joined to the first rib.

11. The propeller fan of claim 1, further comprising a plurality of reinforcing ribs formed on an inner circumferential side of the first rib, each reinforcing rib of the plurality of reinforcing ribs connecting the first rib to a second rib of the plurality of second ribs.

12. The propeller fan of claim 1, wherein an outer circumferential end of each second rib of the plurality of second ribs is directly joined to the first rib.

* * * * *